US012060787B2

(12) United States Patent
Kang et al.

(10) Patent No.: US 12,060,787 B2
(45) Date of Patent: Aug. 13, 2024

(54) SYSTEMS AND METHODS FOR INTEGRATED AND COMPREHENSIVE HYDRAULIC, THERMAL AND MECHANICAL TUBULAR DESIGN ANALYSIS FOR COMPLEX WELL TRAJECTORIES

(71) Applicant: LANDMARK GRAPHICS CORPORATION, Houston, TX (US)

(72) Inventors: Yongfeng Kang, Katy, TX (US); Adolfo Gonzales, Houston, TX (US); Jun Jiang, Austin, TX (US); Robello Samuel, Cypress, TX (US); Zhengchun Liu, Sugar Land, TX (US)

(73) Assignee: LANDMARK GRAPHICS CORPORATION, Houston, TX (US)

( * ) Notice: Subject to any disclaimer, the term of this patent is extended or adjusted under 35 U.S.C. 154(b) by 591 days.

(21) Appl. No.: 17/426,551

(22) PCT Filed: Mar. 5, 2019

(86) PCT No.: PCT/US2019/020825
§ 371 (c)(1),
(2) Date: Jul. 28, 2021

(87) PCT Pub. No.: WO2020/180306
PCT Pub. Date: Sep. 10, 2020

(65) Prior Publication Data
US 2022/0106867 A1 Apr. 7, 2022

(51) Int. Cl.
*E21B 47/007* (2012.01)
*E21B 7/04* (2006.01)
(Continued)

(52) U.S. Cl.
CPC ..... *E21B 47/007* (2020.05); *E21B 7/04* (2013.01); *E21B 47/06* (2013.01); *E21B 47/07* (2020.05); *E21B 2200/20* (2020.05)

(58) Field of Classification Search
CPC ..... E21B 47/007; E21B 47/07
See application file for complete search history.

(56) References Cited

U.S. PATENT DOCUMENTS

2014/0034390 A1* 2/2014 Mitchell ..... E21B 43/128 175/57
2015/0369042 A1 12/2015 Samuel et al.
(Continued)

FOREIGN PATENT DOCUMENTS

EP 2867823 B1 12/2017
WO WO-2016195706 A1 * 12/2016 ..... E21B 17/1035

OTHER PUBLICATIONS

Brown, G.A. et al., "Using Fibre-Optic Distributed Temperature Measurements to Provide Real-Time Reservoir Surveillance Data on Wytch Farm Field Horizontal Extended-Reach Wells", SPE-62952; Society of Petroleum Engineers; 2000.
(Continued)

*Primary Examiner* — Bijan Mapar
(74) *Attorney, Agent, or Firm* — NOVAK DRUCE CARROLL LLP

(57) ABSTRACT

Systems, methods, and computer-readable media for an integrated and comprehensive hydraulic, environmental, and mechanical tubular design analysis workflow and simulator for complex well trajectories. An example method can include obtaining data defining a configuration of a wellbore having a complex well trajectory, one or more operations to be performed at the wellbore, and one or more loads associated with the wellbore; calculating environmental conditions associated with a set of wellbore components along the complex well trajectory based on the data defining
(Continued)

the configuration of the wellbore, the one or more operations, and the one or more loads; calculating stress conditions associated with the set of wellbore components based on the environmental conditions and the data defining the configuration of the wellbore, the one or more operations, and the one or more loads; and presenting the environmental conditions and the stress conditions via a graphical user interface.

18 Claims, 19 Drawing Sheets

(51) Int. Cl.
*E21B 47/06* (2012.01)
*E21B 47/07* (2012.01)

(56) References Cited

U.S. PATENT DOCUMENTS

| | | | |
|---|---|---|---|
| 2016/0119591 | A1 | 4/2016 | Samuel |
| 2016/0314225 | A1 | 10/2016 | Gonzales et al. |
| 2018/0096083 | A1 | 4/2018 | Kang et al. |
| 2018/0128095 | A1 | 5/2018 | Zhang et al. |

OTHER PUBLICATIONS

International Search Report and Written Opinion, PCT Application No. PCT/US2019/020825, Mailed on Dec. 4, 2019.

* cited by examiner 402 404 406 408 410 412 414 416 418 420

Wellpath Editor

| | Data Entry Mode | MD (ft) | INC (°) | AZ (°) | TVD (ft) | DLS (°/100ft) | Max DLS (°/100ft) | Vsection (ft) | Departure (ft) |
|---|---|---|---|---|---|---|---|---|---|
| 1 | INC-AZ-DLS | 0.00 | 0.00 | 0.00 | 0.0 | | | 0.0 | 0.0 |
| 2 | MD-INC-AZ | 1000.0 | 0.00 | 0.00 | 1000.0 | 0.00 | 0.00 | 0.0 | 0.0 |
| 3 | MD-INC-AZ | 1500.0 | 30.00 | 5.00 | 1477.5 | 6.00 | 6.00 | 127.4 | 127.9 |
| 4 | MD-INC-AZ | 3000.0 | 60.00 | 8.00 | 2526.2 | 2.00 | 2.00 | 1168.2 | 1176.2 |
| 5 | MD-INC-AZ | 5000.0 | 75.00 | 9.00 | 3289.4 | 0.75 | 0.75 | 2990.3 | 3018.3 |
| 6 | MD-INC-AZ | 6000.0 | 80.00 | 10.00 | 3505.7 | 0.51 | 0.51 | 3952.9 | 3994.0 |
| 7 | MD-INC-AZ | 6500.0 | 90.00 | 12.00 | 3549.3 | 2.04 | 2.04 | 4441.2 | 4490.9 |
| 8 | MD-INC-AZ | 6700.0 | 90.00 | 12.00 | 3549.3 | 0.00 | 0.00 | 4636.8 | 4690.5 |
| 9 | MD-INC-AZ | 6900.0 | 92.00 | 12.00 | 3545.8 | 1.00 | 1.00 | 4832.4 | 4890.2 |
| 10 | MD-INC-AZ | 7300.0 | 99.00 | 12.00 | 3507.5 | 1.75 | 1.75 | 5221.6 | 5287.5 |
| 11 | MD-INC-AZ | 8000.0 | 90.00 | 12.00 | 3452.8 | 1.29 | 1.29 | 5903.5 | 5983.8 |
| 12 | MD-INC-AZ | 8300.0 | 96.00 | 12.00 | 3436.9 | 2.00 | 2.00 | 6196.4 | 6283.0 |
| 13 | MD-INC-AZ | 8600.0 | 82.00 | 12.00 | 3442.1 | 4.67 | 4.67 | 6489.1 | 6581.9 |
| 14 | MD-INC-AZ | 9000.0 | 96.00 | 12.00 | 3449.1 | 3.50 | 3.50 | 6879.3 | 6980.6 |
| 15 | MD-INC-AZ | 10000. | 90.00 | 12.00 | 3396.8 | 0.60 | 0.60 | 7855.7 | 7978.1 |
| 16 | MD-INC-AZ | 10500. | 80.00 | 12.00 | 3440.3 | 2.00 | 2.00 | 8342.3 | 8475.3 |
| 17 | MD-INC-AZ | 11000. | 94.00 | 12.00 | 3466.4 | 2.80 | 2.80 | 8829.4 | 8973.1 |
| 18 | MD-INC-AZ | 12000. | 85.00 | 12.00 | 3475.1 | 0.90 | 0.90 | 9806.5 | 9971.6 |
| 19 | MD-INC-AZ | 13000. | 80.00 | 12.00 | 3605.6 | 0.50 | 0.50 | 10776.0 | 10962.4 |
| 20 | MD-INC-AZ | 13500. | 75.00 | 12.00 | 3713.8 | 1.00 | 1.00 | 11263.3 | 11450.3 |
| 21 | MD-INC-AZ | 14107. | 75.00 | 12.00 | 3871.0 | 0.00 | 0.00 | 11827.4 | 12037.0 |
| 22 | | | | | | | | | |

Section View

422

1100

1102 1104 1106 1108 1110

MultiString Annular Fluid Expansion Summary - ProdBlackOilGas-4M

| | String Annulus | Region | | | Device Failure | | Incremental AFE Pressure (1) (psi) | Incremental AFE Volume (2) (bbl) |
|---|---|---|---|---|---|---|---|---|
| | | | Top (ft) | Base (ft) | Disk | Foam | | |
| 1 | 13 3/8" Intermediate Casing | Region 1 | 0.0 | 656.2 | - | - | 780.00 | 0.3 |
| 2 | 9 5/8" Drilling Casing | Region 1 | 0.0 | 7217.8 | - | - | 327.00 | 0.6 |
| 3 | 7" Protective Casing | Region 1 | 0.0 | 8858.3 | - | - | 328.00 | 0.3 |
| 4 | 4 1/2" Production Tubing | Region 1 | 0.0 | 14000.0 | - | - | 268.00 | 0.2 |
| 5 | | | | | | | | |
| 6 | (1) Pressure change caused by the Annular Fluid Expansion (AFE) phenomenon --- | | | | | | | |
| 7 | (2) Volume change caused by the Annular Fluid Expansion (AFE) effect --- | | | | | | | |

FIG. 11

SYSTEMS AND METHODS FOR INTEGRATED AND COMPREHENSIVE HYDRAULIC, THERMAL AND MECHANICAL TUBULAR DESIGN ANALYSIS FOR COMPLEX WELL TRAJECTORIES

CROSS-REFERENCE TO RELATED APPLICATIONS

This application is a national stage entry of PCT/US2019/020825 filed Mar. 5, 2019, said application is expressly incorporated herein by reference in its entirety.

TECHNICAL FIELD

The present technology pertains to analyzing and simulating conditions in wells with complex trajectories.

BACKGROUND

In modern oil and gas exploration and production, the path or trajectory of wells have become increasingly complex. For example, modern wells often have undulating trajectories at different points or sections of the well path. Such wells can have complex trajectories for various reasons, such as irregularly formed reservoirs, faults in the reservoir, unconventional resources necessitating high contact with the pay zone formation, etc. This complexity in the well trajectory of a wells can create significant challenges in modern well planning, casing, tubing design, and well completion, as various important factors, such as pressure, temperature, stress, and safety profiles of the well and its associated components, can be very difficult to model.

For example, pressure and temperature profiles from fluid and heat flow in different operation scenarios and shut-in conditions where water, oil and/or gas may resettle down can be extremely difficult to model in wells with complex trajectories. Without adequate understanding of the pressure and temperature profiles of a well, it can be difficult to estimate the presence of trapped annular pressure and fluid expansion, which are often caused by downhole pressure, temperatures, and stresses. Moreover, casing and tubing string design in wells with complex trajectories can be significantly challenging due to additional stress caused by the complex trajectory of the well and the uncertainty in the well's temperature, pressure and related stress changes induced by the complex trajectory of the well. These and other limitations can greatly reduce production rates and have a negative impact on safety and design considerations associated with such complex wells.

BRIEF DESCRIPTION OF THE DRAWINGS

In order to describe the manner in which the above-recited and other advantages and features of the disclosure can be obtained, a more particular description of the principles briefly described above will be rendered by reference to specific embodiments thereof which are illustrated in the appended drawings. Understanding that these drawings depict only exemplary embodiments of the disclosure and are not therefore to be considered to be limiting of its scope, the principles herein are described and explained with additional specificity and detail through the use of the accompanying drawings in which:

FIG. 11 is a table of example trapped annular pressure buildup (APB) and trapped annular fluid expansion (AFE) calculation results from a well system analysis performed for a wellbore with a complex well trajectory, in accordance with some examples;

DETAILED DESCRIPTION

Figure 1A:
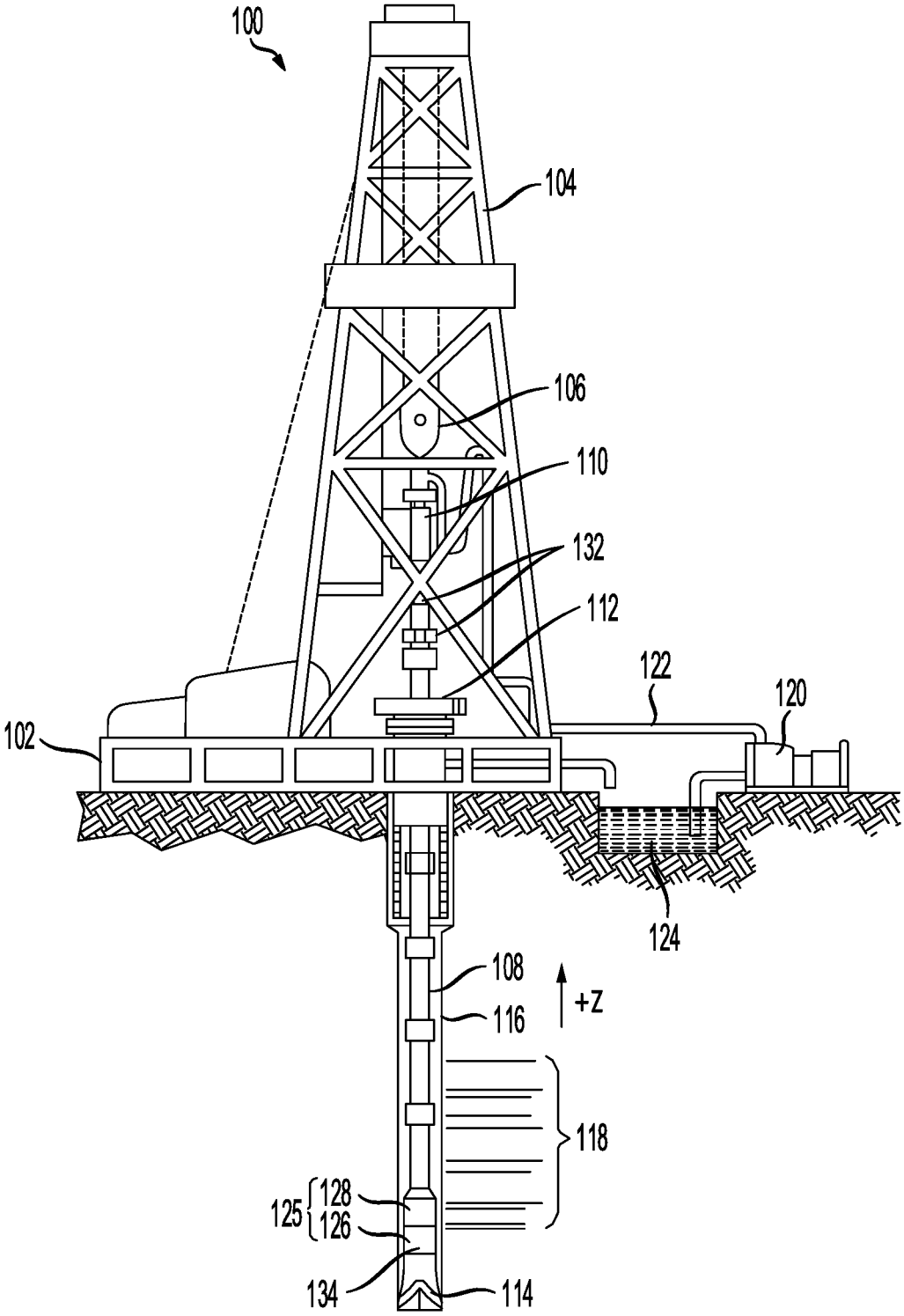
FIG. 1A is a schematic diagram of an example logging while drilling (LWD) wellbore operating environment, in accordance with some examples.

Various embodiments of the disclosure are discussed in detail below. While specific implementations are discussed, it should be understood that this is done for illustration purposes only. A person skilled in the relevant art will recognize that other components and configurations may be used without parting from the spirit and scope of the disclosure.

Additional features and advantages of the disclosure will be set forth in the description which follows, and in part will be obvious from the description, or can be learned by practice of the herein disclosed principles. The features and advantages of the disclosure can be realized and obtained by means of the instruments and combinations particularly pointed out in the appended claims. These and other features of the disclosure will become more fully apparent from the following description and appended claims, or can be learned by the practice of the principles set forth herein.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures and components have not been described in detail so as not to obscure the related relevant feature being described. The drawings are not necessarily to scale and the proportions of certain parts may be exaggerated to better illustrate details and features. The description is not to be considered as limiting the scope of the embodiments described herein.

Disclosed are systems, methods, and computer-readable storage media for an integrated and comprehensive hydraulic, environmental (e.g., temperature, pressure, fluid flow, heat transfer, etc.), and mechanical well design analysis workflow and simulator for complex well trajectories. In some examples, the technologies and approaches herein can provide an integrated and comprehensive design analysis and workflow solution capable of accurately modeling the fluid flow, heat transfer, and temperature and pressure profiles (e.g., environmental profiles) of a well with a complex trajectory, such as an undulating trajectory. Moreover, the technologies and approaches herein can enable accurate and effective stress analysis and well string design for wells with complex trajectories. For example, the tools herein can accurately estimate pressure and temperature profiles of a complex well (e.g., a well having a complex trajectory) at different well lifecycle stages, and use such estimated profiles to perform well and string stress analysis as well as accurate casing and tubing design.

The modeling and design analysis tools herein can be advantageously used for any modern resource (e.g., oil, gas, etc.) exploration and production operations such as, without limitation, unconventional resource exploration and production, deep water exploration and production, and extended reach well (ERW) operations, in order to increase the hydrocarbon pay zone contact in the formation for better production rates. As previously explained, temperature and pressure can greatly affect the properties of materials. Accordingly, by providing accurate calculation and modeling of temperature and pressure profiles associated with a well, the technologies herein can also help guide drilling operations (e.g., such as drilling, circulation, cementing, etc.), injection operations, fracturing operations, and other workover fluid selections for various scenarios.

According to at least one example, a method for an integrated and comprehensive hydraulic, environmental, and mechanical well design analysis workflow and simulator is provided. The method can include obtaining data defining a configuration of a wellbore having a complex well trajectory, one or more operations to be performed at the wellbore, and one or more loads associated with the wellbore; calculating environmental conditions (e.g., temperature, pressure, fluid flow, heat transfer, etc.) associated with wellbore components along the complex well trajectory based on the data defining the configuration of the wellbore, the one or more operations, and the one or more loads; calculating stress conditions associated with the wellbore components based on the environmental conditions and the data defining the configuration of the wellbore, the one or more operations, and the one or more loads; and presenting the environmental conditions and the stress conditions via a graphical user interface. In some examples, the complex well trajectory can include one or more undulating sections.

In another example, a system for an integrated and comprehensive hydraulic, environmental, and mechanical well design analysis workflow and simulator is provided. The system can include one or more processors and at least one computer-readable storage medium having stored therein instructions which, when executed by the one or more processors, cause the system to obtain data defining a configuration of a wellbore having a complex well trajectory, one or more operations to be performed at the wellbore, and one or more loads associated with the wellbore; calculate environmental conditions (e.g., temperature, pressure, fluid flow, heat transfer, etc.) associated with wellbore components along the complex well trajectory based on the data defining the configuration of the wellbore, the one or more operations, and the one or more loads; calculate stress conditions associated with the wellbore components based on the environmental conditions and the data defining the configuration of the wellbore, the one or more operations, and the one or more loads; and present the environmental conditions and the stress conditions via a graphical user interface. In some examples, the complex well trajectory can include one or more undulating sections.

In another example, a non-transitory computer-readable storage medium for an integrated and comprehensive hydraulic, environmental, and mechanical well design analysis workflow and simulator is provided. The non-transitory computer-readable storage medium can include instructions which, when executed by one or more processors, cause the one or more processors to obtain data defining a configuration of a wellbore having a complex well trajectory, one or more operations to be performed at the wellbore, and one or more loads associated with the wellbore; calculate environmental conditions (e.g., temperature, pressure, fluid flow, heat transfer, etc.) associated with wellbore components along the complex well trajectory based on the data defining the configuration of the wellbore, the one or more operations, and the one or more loads; calculate stress conditions associated with the wellbore components based on the environmental conditions and the data defining the configuration of the wellbore, the one or more operations, and the one or more loads; and present the environmental conditions and the stress conditions via a graphical user interface. In some examples, the complex well trajectory can include one or more undulating sections.

In yet another example, a system or apparatus for an integrated and comprehensive hydraulic, environmental, and mechanical well design analysis workflow and simulator is provided. The system or apparatus can include means for obtaining data defining a configuration of a wellbore having a complex well trajectory, one or more operations to be performed at the wellbore, and one or more loads associated with the wellbore; calculating environmental conditions (e.g., temperature, pressure, fluid flow, heat transfer, etc.) associated with wellbore components along the complex well trajectory based on the data defining the configuration of the wellbore, the one or more operations, and the one or more loads; calculating stress conditions associated with the wellbore components based on the environmental conditions and the data defining the configuration of the wellbore, the one or more operations, and the one or more loads; and presenting the environmental conditions and the stress conditions via a graphical user interface. In some examples, the complex well trajectory can include one or more undulating sections.

As previously explained, temperature and pressure can greatly impact the properties of materials, thus affecting the stress, safety, design, and operational conditions of a well and its associated components. However, the temperature, pressure, stress, safety conditions of a well with a complex trajectory can be extremely difficult to calculate. This complexity in the trajectory of a well can create significant challenges in modern well planning, casing, tubing design, and well completion. The disclosed technologies address the need in the art for tools accurate and efficient well system design analysis and modeling of hydraulic, environmental (e.g., temperature, pressure, fluid flow, heat transfer, etc.), and mechanical conditions in wells with complex trajectories.

As follows, the disclosure will begin with a description of example systems and environments, as illustrated in FIGS. 1A-C and 2, for hydraulic, environmental, and mechanical design analysis and simulation in complex well trajectories. A detailed description of example systems, methods, and technologies for integrated and comprehensive hydraulic, environmental, and mechanical design analysis and simulation in complex well trajectories, as shown in FIGS. 3-13, will then follow. The disclosure concludes with a description of an example computing system architecture, as shown in FIG. 14, which can be implemented for performing computing operations and functions as disclosed herein. These variations shall be described herein as the various embodiments are set forth. The disclosure now turns to FIG. 1A.

FIG. 1A illustrates a schematic view of a logging while drilling (LWD) wellbore operating environment 100 in in accordance with some examples of the present disclosure. As depicted in FIG. 1A, a drilling platform 102 can be equipped with a derrick 104 that supports a hoist 106 for raising and lowering a drill string 108. The hoist 106 suspends a top drive 110 suitable for rotating and lowering the drill string 108 through a well head 112. A drill bit 114 can be connected to the lower end of the drill string 108. As the drill bit 114 rotates, the drill bit 114 creates a wellbore 116 that passes through various formations 118. A pump 120 circulates drilling fluid through a supply pipe 122 to top drive 110, down through the interior of drill string 108 and orifices in drill bit 114, back to the surface via the annulus around drill string 108, and into a retention pit 124. The drilling fluid transports cuttings from the wellbore 116 into the retention pit 124 and aids in maintaining the integrity of the wellbore 116. Various materials can be used for drilling fluid, including oil-based fluids and water-based fluids.

Logging tools 126 can be integrated into the bottom-hole assembly 130 near the drill bit 114. As the drill bit 114 extends the wellbore 116 through the formations 118, logging tools 126 collect measurements relating to various formation properties as well as the orientation of the tool and various other drilling conditions. The bottom-hole assembly 130 may also include a telemetry sub 128 to transfer measurement data to a surface receiver 132 and to receive commands from the surface. In at least some cases, the telemetry sub 128 communicates with a surface receiver 132 using mud pulse telemetry. In some instances, the telemetry sub 128 does not communicate with the surface, but rather stores logging data for later retrieval at the surface when the logging assembly is recovered.

Each of the logging tools 126 may include one or more tool components spaced apart from each other and communicatively coupled with one or more wires and/or other media. The logging tools 126 may also include one or more computing devices 134 communicatively coupled with one or more of the one or more tool components by one or more wires and/or other media. The one or more computing devices 134 may be configured to control or monitor a performance of the tool, process logging data, and/or carry out one or more aspects of the methods and processes of the present disclosure.

In at least some instances, one or more of the logging tools 126 may communicate with a surface receiver 132 by a wire, such as wired drillpipe. In other cases, the one or more of the logging tools 126 may communicate with a surface receiver 132 by wireless signal transmission. In at least some cases, one or more of the logging tools 126 may receive electrical power from a wire that extends to the surface, including wires extending through a wired drillpipe.

Figure 1B:
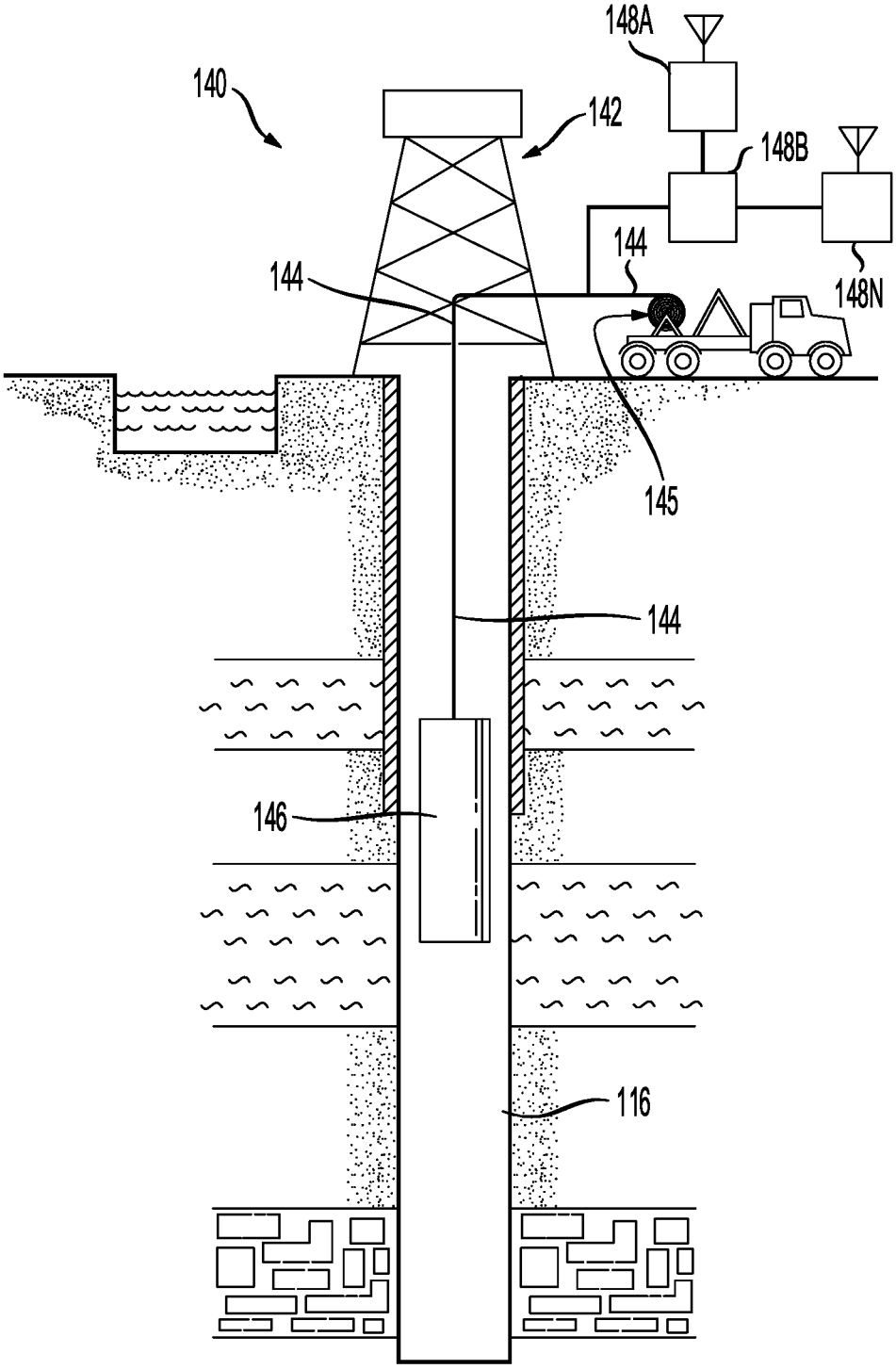
FIG. 1B is a schematic diagram of an example downhole environment having tubulars, in accordance with some examples.

Referring to FIG. 1B, an example system 140 for downhole line detection in a downhole environment having tubulars can employ a tool having a tool body 146 in order to carry out logging and/or other operations. For example, instead of using the drill string 108 of FIG. 1A to lower tool body 146, which may contain sensors or other instrumentation for detecting and logging nearby characteristics and conditions of the wellbore 116 and surrounding formation, a wireline conveyance 144 can be used. The tool body 146 can include a resistivity logging tool. The tool body 146 can be lowered into the wellbore 116 by wireline conveyance 144. The wireline conveyance 144 can be anchored in the drill rig 145 or a portable means such as a truck. The wireline conveyance 144 can include one or more wires, slicklines, cables, and/or the like, as well as tubular conveyances such as coiled tubing, joint tubing, or other tubulars.

The illustrated wireline conveyance 144 provides support for the tool, as well as enabling communication between tool processors 148A-N on the surface and providing a power supply. In some examples, the wireline conveyance 144 can include electrical and/or fiber optic cabling for carrying out communications. The wireline conveyance 144 is sufficiently strong and flexible to tether the tool body 146 through the wellbore 116, while also permitting communication through the wireline conveyance 144 to one or more processors 148A-N, which can include local and/or remote processors. Moreover, power can be supplied via the wireline conveyance 144 to meet power requirements of the tool. For slickline or coiled tubing configurations, power can be supplied downhole with a battery or via a downhole generator.

In oil and gas exploration and production, a well trajectory can in some cases be quite complex. For example, a well trajectory can have sections with undulating trajectories and/or other irregular trajectories. The well trajectory can be complex for various reasons, such as, for example, the reservoir having an irregular form, faults in the reservoir, unconventional resources needing high contact with the pay zone formation, and so on. Such complexity can create many challenges for well planning, casing and tubing design, and well completion. For example, in a complex well trajectory, it can be very difficult to model the pressure and temperature profiles from fluid and heat flow in different operation scenarios and shut-in conditions where fluids (e.g., water, oil and/or gas) may re-settle at a bottom. As another example, it can be very difficult to perform casing and tubing string design in such environments due to the additional uncertainty on the temperature and pressure, as well as the related induced stress change and additional stress from the complex well trajectory.

Figure 1C:
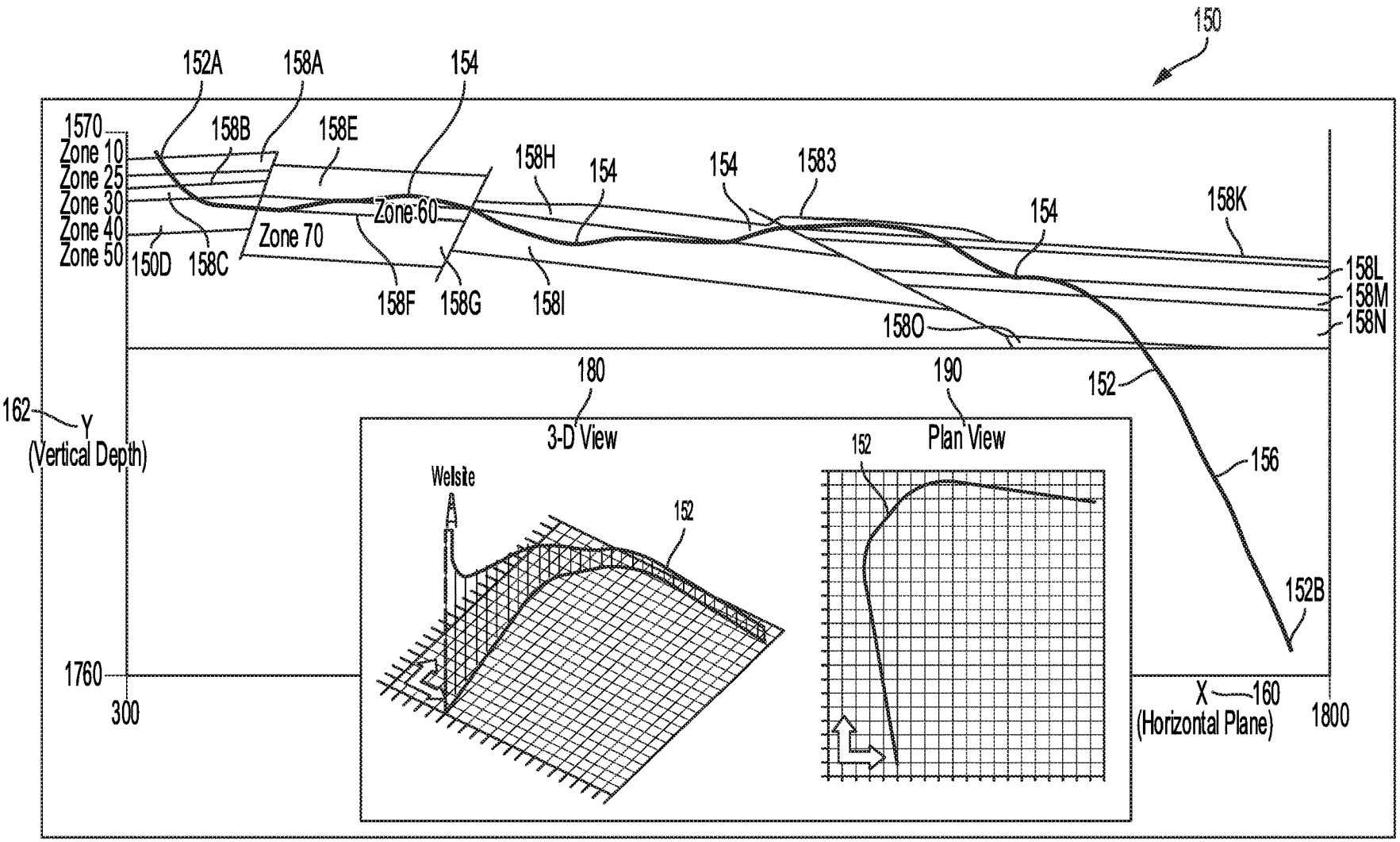
FIG. 1C is a schematic diagram of an example wellbore environment having an example complex well trajectory, in accordance with some examples.

FIG. 1C illustrates a wellbore environment 150 having an example complex well trajectory 156. The complex well trajectory 156 in this example traverses from a starting point 152A to an end 152B of the complex well trajectory 156 and has varying trajectories at different points along a horizontal plane 160 depicting a horizontal distance and a vertical plane 162 depicting a vertical depth of the complex well trajectory 156. The complex well trajectory 156 can traverse through various zones 158A-N along the horizontal plane 160 and the vertical plane 162. Moreover, the various zones 158A-N can have differing compositions, conditions, characteristics, formations, vertical depths, horizontal distances, and so forth.

The complex well trajectory 156 can also have one or more undulating trajectories 154 along the complex well trajectory 156. In some examples, the complex well trajectory 156 can also have one or more vertical sections 156. The complex well trajectory 156 can also have other sections such as, for example, one or more horizontal sections and/or one or more sections with different angles or irregular trajectories.

The three-dimensional (3D) view 180 and plan view 190 shown in FIG. 1C provide different perspectives of the complex well trajectory 156. As illustrated in the 3D view 180 and the plan view 190, the complex well trajectory 156 has different trajectories and characteristics along the path of the complex well trajectory 156.

Figure 2:
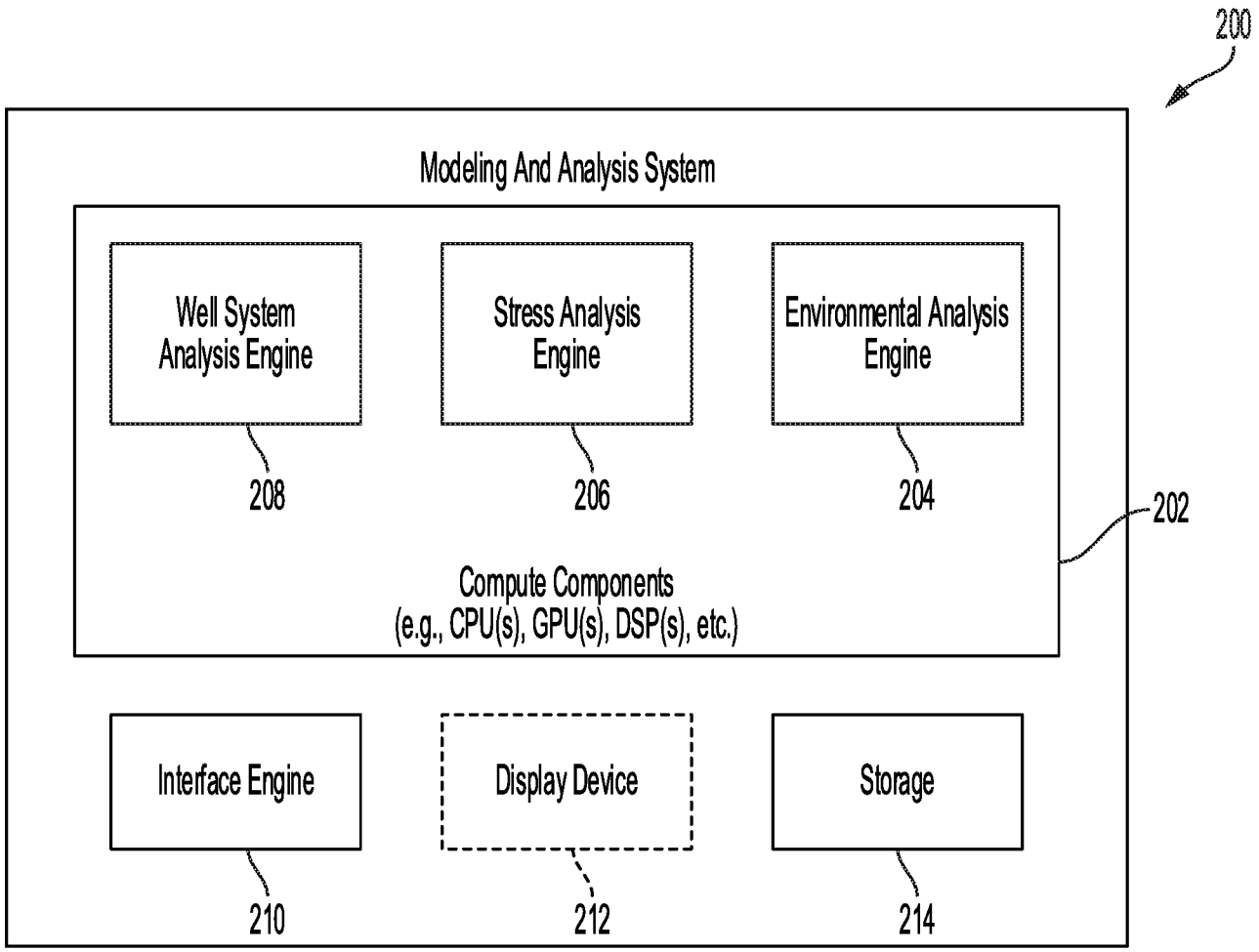
FIG. 2 is a block diagram of an example modeling and analysis system which can be implemented for design analysis and simulation in complex well trajectories, in accordance with some examples.

Having disclosed example drilling environments and tools, the disclosure now turns to FIG. 2, which illustrates an example modeling and analysis system 200. The modeling and analysis system 200 can be implemented for hydraulic, environmental (e.g., temperature, pressure, fluid flow, heat transfer, etc.), and mechanical design analysis and simulation in complex well trajectories, such as complex well trajectory 156. In this example, the modeling and analysis system 200 can include compute components 202, an environmental analysis engine 204, a stress analysis engine 206, a well system analysis engine 208, an interface engine 210, and a storage 214. In some implementations, the modeling and analysis system 200 can also include a display device 212 for displaying data and graphical elements such as tables, images, videos, and any other media content.

The modeling and analysis system 200 can be part of, or implemented by, one or more computing devices, such as one or more servers, one or more personal computers, one or more processors, one or more mobile devices (e.g., a smartphone, a camera, a laptop computer, a tablet computer, a smart device, etc.), and/or any other suitable electronic device. In some cases, the one or more computing devices that include or implement the modeling and analysis system 200 can include one or more hardware components such as, for example, one or more wireless transceivers, one or more input devices, one or more output devices (e.g., display device 212), one or more sensors (e.g., an image sensor, a temperature sensor, a pressure sensor, an altitude sensor, a proximity sensor, an inertial measurement unit, etc.), one or more storage devices (e.g., storage system 214), one or more processing devices (e.g., compute components 202), etc.

As previously mentioned, the modeling and analysis system 200 can include compute components 202. The compute components 202 can be used to implement the environmental analysis engine 204, the stress analysis engine 206, the well system analysis engine 208, and the interface engine 210. The compute components 202 can also be used to control, communicate with, and/or interact with the display device 212 and the storage system 214. The compute components 202 can include electronic circuits and/or other electronic hardware, such as, for example and without limitation, one or more programmable electronic circuits. For example, the compute components 202 can include one or more microprocessors, one or more graphics processing units (GPUs), one or more digital signal processors (DSPs), one or more central processing units (CPUs), one or more image signal processors (ISPs), and/or any other suitable electronic circuits and/or hardware. Moreover, the compute components 202 can include and/or can be implemented using computer software, firmware, or any combination thereof, to perform the various operations described herein.

The environmental analysis engine 204 can be used to estimate the temperature and pressure profiles for the well components at a complex well trajectory (e.g., complex well trajectory 156). The temperature profiles can include temperature profiles for all the flow stream and strings, such as tubing fluid temperature, tubing temperature, a casing, a first annulus, a second annulus, etc., and the temperature profile in the formation near the wellbore with radial distance around the well. The pressure profiles can include pressure profiles for all the flow stream. Moreover, the environmental analysis engine 204 can perform the heat transfer and fluid flowing calculations for specific operations and/or workovers from a drilling phase to a production phase using specific parameters and/or data, which can be detected by one or more devices and/or defined via a graphical user interface. Non-limiting examples of such parameters and data can include formation and wellbore configurations, simulation conditions (transient or steady state), fluid types, operation depth, flow rate, inlet temperature, duration, flow direction (e.g., drilling, cementing, condition, trips and circulation, injection, production, forward circulation, reverse circulation, etc.), reference pressure and location (e.g., at wellhead, at perforation, etc.), and any other condition or parameter associated with the well system.

The stress analysis engine 206 can perform a stress analysis for the well system. The stress analysis can be based on one or more factors and/or parameters such as, for example, a load and well configuration. Moreover, the stress analysis engine 206 can apply the corresponding temperature and pressure profiles calculated by the environmental analysis engine 204 to each string (e.g., each tubing, casing, liner, work string, etc.) of the well system, and perform the stress analysis for each string taking into account updated temperature and pressure profiles (e.g., resulting from conditions and/or effects of the complex well trajectory), and under the direct effect of the complex well trajectory (e.g., 156). The stress analysis engine 206 can calculate a load for a specific wellbore configuration, the mechanical properties of the casing and tubing, the internal and external pressure and temperature (e.g., calculated by the environmental analysis engine 204), a load type (e.g., over-pull, pressure test, running in hole, tubing evacuation, etc.), the combined loads of internal and external density and/or pressure and associated temperature (e.g., predicted by the environmental analysis engine 204), etc.

The well system analysis engine 208 can apply the updated temperature and pressure profiles resulting from the complex well trajectory (e.g., 156) to perform multi-string analysis with trapped annular fluid expansion (AFE) and trapped annular pressure buildup (APB) analysis, wellhead movement, wellhead contact load, impacting of APB on stress analysis (e.g., safety factors, stress, length change, string displacement, design limits, etc.), and so forth. In some examples, the well system analysis engine 208 can perform the stress analysis in the view of a multi-string system of the well system and one or more settings of annular contents, initial and final conditions (e.g., a temperature and/or pressure change), load history, wellhead installation and load configuration, etc.

In some examples, the interface engine 210 can generate and/or provide a graphical user interface (GUI) where a user can input data and/or parameters to be used by the environmental analysis engine 204, the stress analysis engine 206, and/or the well system analysis engine 208 to perform their respective calculations. For example, the interface engine 210 can generate and/or provide a GUI where a user can define one or more aspects of the wellbore (e.g., 150), such as a wellpath or trajectory (e.g., complex well trajectory 156), casing and tubing configurations, fluids, packers, etc.; one or more aspects of the formation and properties around the wellbore (e.g., 150); one or more operation and/or workover details; a stress analysis load type and/or configuration; a multi-string load history; etc., which can be used by the modeling and analysis system 200 to analyze the well system.

In some examples, the GUI generated and/or provided by the interface engine 210 can also display the output and/or results of the modeling and analysis system 200 (e.g., the analysis and/or results generated by the environmental analysis engine 204, the stress analysis engine 206, and/or the well system analysis engine 208). For example, the GUI generated and/or provided by the interface engine 210 can display the calculated temperature and pressure profiles, fluid properties (e.g., density, viscosity, liquid hold up, flow regime, etc.), load, stress, safety factors (e.g., axial, triaxial, collapse, burst, etc.), displacement, length change, wellhead movement, trapped annular pressure build-up (APB), annular fluid expansion (AFE), etc. The GUI can display such calculations and results in any graphical configuration and/or format. For example, the GUI can display calculations and results in a spreadsheet, a chart, a report, a log, a table, a list, a graph, a diagram, a text document, an image, and/or in any other form.

The interface engine 210 can provide, display and/or render the GUI (and its associated content and interface elements) on a display device 212. In some cases, the display device 212 can be part of or implemented by the modeling and analysis system 200. Here, the interface engine 210 can generate the GUI and provide or render the GUI on the display device 212. In other cases, the display device 212 can be separate from the modeling and analysis system 200. For example, the display device 212 can be a separate and/or remote display. In this example, the modeling and analysis system 200 can send or provide the GUI generated by the interface engine 210 to the display device 212 and/or a computing device implementing the display device 212, for presentation at the display device 212.

The storage 214 can be any storage device(s) for storing data. In some examples, the storage 214 can include a buffer or cache for storing data for processing by the compute components 202. Moreover, the storage 214 can store data from any of the components of the modeling and analysis system 200. For example, the storage 214 can store input data used by the modeling and analysis system 200, outputs or results generated by the modeling and analysis system 200 (e.g., data and/or calculations from the environmental analysis engine 204, the stress analysis engine 206, the well system analysis engine 208, the interface engine 210, etc.), user preferences, parameters and configurations, data logs, documents, software, media items, GUI content, and/or any other data and content.

While the modeling and analysis system 200 is shown in FIG. 2 to include certain components, one of ordinary skill in the art will appreciate that the modeling and analysis system 200 can include more or fewer components than those shown in FIG. 2. For example, in some instances, the modeling and analysis system 200 can also include one or more memory components (e.g., one or more RAMs, ROMs, caches, buffers, and/or the like), one or more input components, one or more output components, one or more processing devices, and/or one or more hardware components that are not shown in FIG. 2.

Figure 3:
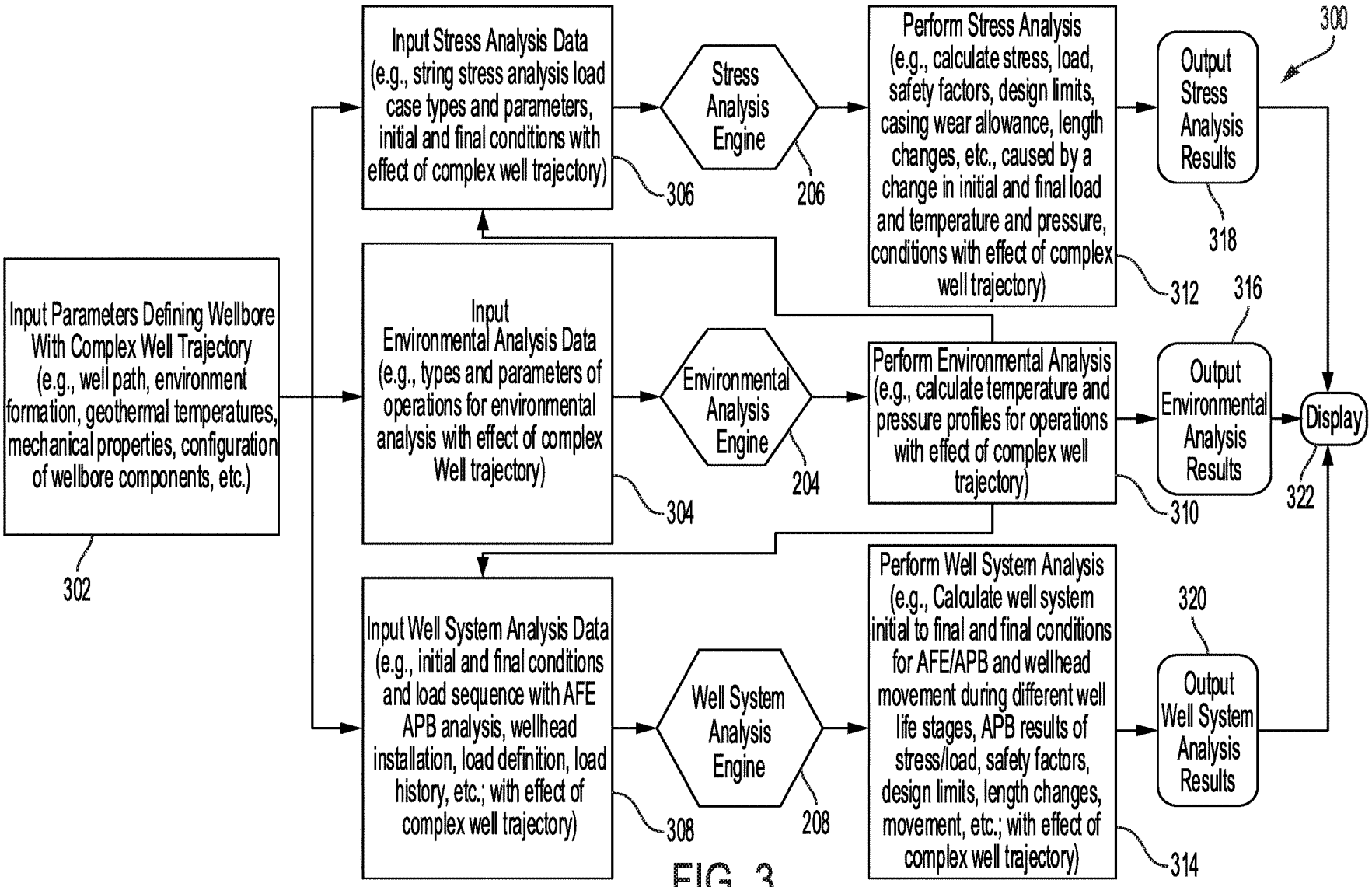
FIG. 3 is a flowchart of an example process for performing hydraulic, environmental, and mechanical design analysis and simulation for complex well trajectories, in accordance with some examples.

FIG. 3 illustrates a flowchart of an example process 300 for performing an integrated and comprehensive hydraulic, environmental, and mechanical tubular design analysis and simulation for complex well trajectories (e.g., 156). At step 302, the modeling and analysis system 200 can obtain input data defining a wellbore (e.g., 150) with a complex well trajectory (e.g., 156). The input data can be used to perform the environmental, stress, and well system analysis and/or simulation described herein.

In some cases, the input data can define, for example and without limitation, a well path and/or complex well trajectory (e.g., 156) associated with the wellbore (e.g., 150), the formation and properties around the wellbore (e.g., 150), geothermal temperatures associated with the wellbore (e.g., 150), a configuration of one or more casings associated with the wellbore (e.g., 150), a configuration of one or more tubings associated with the wellbore (e.g., 150), one or more fluids (e.g., type of fluids, fluid characteristics, etc.) associated with the wellbore (e.g., 150), mechanical properties (e.g., mechanical properties of the casing(s), mechanical properties of the tubing(s), etc.) associated with the wellbore (e.g., 150), and/or any other parameters and configuration data associated with the wellbore (e.g., 150).

At step 304, the modeling and analysis system 200 can receive input environmental analysis data for the environmental analysis engine 204. The input environmental analysis data can include information and parameters used by the environmental analysis engine 204 to perform an environmental analysis associated with the wellbore (e.g., 150). For example, the environmental analysis data can define the formation properties (such as heat capacity, heat conductivity, formation types and depths, etc.), geothermal properties (e.g., geothermal gradient), well trajectory, wellbore configurations (e.g., casing size and material, tubing size and material, and annulus contents, etc.), the operation types (drilling, cementing, production, circulation, injection, etc.), fluid types (such as brines, oil based mud, oil based mud, synthetic fluid, foam, etc.) and properties (e.g., density, rheology, thermal properties, etc.), and/or any other parameters and configuration data relevant to calculating environmental conditions or characteristics associated with the wellbore (e.g. 150).

At step 306, the modeling and analysis system 200 can receive input stress analysis data for the stress analysis engine 206. The input stress analysis data can include, for example and without limitation, load configurations, a load type (e.g., overpull, pressure test, running in hole, tubing evacuation, etc.), mechanical properties (e.g., mechanical properties of a casing and/or tubing) associated with the wellbore (e.g., 150), initial and final conditions (e.g., initial and final temperatures, pressures, loads, casing and/or tubing characteristics, fluid characteristics, etc.) associated with the wellbore (e.g., 150) and/or stress analysis, a casing type(s), an internal and/or external pressure and/or temperature, and/or any other parameters and configuration data relevant to calculating stress conditions or characteristics associated with the wellbore (e.g., 150).

At step 308, the modeling and analysis system 200 can receive input well system analysis data for the well system analysis engine 208. The input well system analysis data can include information for performing a multi-string analysis with trapped annular fluid expansion (AFE), a trapped annular pressure buildup (APB) analysis, a wellhead movement analysis, a wellhead contact load analysis, an impact of APB on the stress analysis (e.g., an impact on safety factors, stress, length change, string displacement, design limits, etc.). In some examples, the input well system analysis data can include, without limitation, initial and final conditions associated with the well system analysis (e.g., temperature changes, pressure changes, etc.), a load sequence with AFE and/or APB analysis information, a load history, a load configuration, a wellhead installation, annular contents and/or conditions, and/or any other well system parameters or conditions.

In some examples, the modeling and analysis system 200 can receive some or all of the input data at steps 302, 304, 306, and/or 308 from a user via a GUI provided and/or generated by the interface engine 210 of the modeling and analysis system 200. In other examples, the modeling and analysis system 200 can sense or measure some or all of the input data from steps 302, 304, 306, and/or 308 and/or receive some or all of the input data at steps 302, 304, 306, and/or 308 from a remote device such as a server, a personal computer, a mobile device, a sensor(s), and/or any other suitable electronic device.

Moreover, the modeling and analysis system 200 can provide the input data from steps 302 and 304 to the environmental analysis engine 204 for environmental analysis calculations, the input data from steps 302 and 306 to the stress analysis engine 206 for stress analysis calculations, and the input data from steps 302 and 308 to the well system analysis engine 208 for well system analysis calculations.

At step 310, the environmental analysis engine 204 can obtain the input data from steps 302 and 304 and perform an environmental analysis for the wellbore (e.g., 150). The environmental analysis engine 204 can use the input data to estimate the temperature and pressure profiles for one or more well components (e.g., one or more strings, casings, tubings, etc.) at the complex well trajectory (e.g., 156). In one illustrative example, the temperature and pressure profiles can include drilling and production initial and final temperature and pressure profiles for the one or more well components. Moreover, the temperature profiles can include temperature profiles for all the flow stream and strings, such as tubing fluid temperature, tubing temperature, casing temperature, annulus temperature, etc., and also the temperature in the formation around the well; and the pressure profiles can include pressure profiles for the flow stream.

In some examples, the environmental analysis engine 204 can use the input data to perform heat transfer and fluid flowing calculations for specific operations and/or workovers from a drilling phase to a production phase. In some cases, at least some of the input data used by the environmental analysis engine 204 for such calculations at step 310 can include, for example, formation and wellbore configurations, simulation conditions (e.g., transient or steady state), fluid types, operation depth, flow rate, inlet temperature, duration, flow direction (e.g., drilling, cement, condition, trips and circulation, injection, production, forward circulation, reverse circulation, etc.), reference pressure and location (e.g., at wellhead, at perforation, etc.), and so forth.

At step 312, the stress analysis engine 206 can obtain the input data from steps 302 and 306, as well as the output of the environmental analysis engine 204 at step 310 (e.g., the calculated temperature and pressure profiles), and perform a stress analysis for the wellbore (e.g., 150). The stress analysis engine 206 can apply the temperature and pressure profiles calculated by the environmental analysis engine 204 to one or more well components (e.g., one or more strings, tubings, casings, liners, etc.), and perform the stress analysis for the one or more well components taking into account updated temperature and pressure profiles (e.g., resulting from conditions and/or effects of the complex well trajectory), and under the direct effect of the complex well trajectory (e.g., 156).

In some examples, the stress analysis performed by the stress analysis engine 206 can include a calculation of a load and/or stress for a specific wellbore configuration and/or well components (e.g., one or more casings, tubings, strings, etc.), the mechanical properties of the casing and tubing, the internal and external pressure and temperature (e.g., calculated by the environmental analysis engine 204), a load type (e.g., overpull, pressure test, running in hole, tubing evacuation, etc.), the combined loads of internal and external densities and/or pressures and associated temperatures (e.g., predicted by the environmental analysis engine 204), safety factors (e.g., axial, triaxial, collapse, burst, etc.), design limits, casing wear allowance, length changes, displacement, and/or any other load or stress conditions caused by changes between the initial to final load, temperature, and/or pressure conditions associated with the wellbore (e.g., 150).

At step 314, the well system analysis engine 208 can obtain the input data from steps 302 and 308, as well as the output of the environmental analysis engine 204 at step 310 (e.g., the calculated temperature and pressure profiles), and perform a well system analysis for the wellbore (e.g., 150). In one illustrative example, the well system analysis engine 208 can apply the updated temperature and pressure profiles calculated by the environmental analysis engine 204 and perform a well system analysis from initial to final conditions including calculations of trapped AFE, APB, and wellhead movement during different well life stages, as well as APB results from stress, load, safety factors, design limits, length changes, movement, etc.

Moreover, in some cases, the well system analysis engine 208 can additionally and/or alternatively calculate other well system aspects such as wellhead contact load, impact of APB on stress conditions (e.g., safety factors, stress, length change, string displacement, design limits, etc.), and so forth. In some examples, the well system analysis engine 208 can perform the stress analysis in the view of a multi-string system of the well system and one or more settings of annular contents, initial and final conditions (e.g., a temperature and/or pressure change), load history, wellhead installation and load configuration, etc.

At step 316, the environmental analysis engine 204 can generate an output including the environmental analysis results from step 310. Similarly, at step 318, the stress analysis engine 206 can generate an output including the stress analysis results from step 312, and at step 320, the well system analysis engine 208 can generate an output including the well system analysis results from step 314.

At step 322, the modeling and analysis system 200 can then provide the outputs from steps 316, 318, and 320 (e.g., the analysis results from the environmental analysis engine 204, the stress analysis engine 206, and the well system analysis engine 208) to a display device (e.g., 212) for presentation to a user. The display device can then display the environmental, stress, and well system analysis results for the user. The output results can be display in any graphical format, configuration, and/or scheme. For example, the output results can be displayed in (or as) a spreadsheet document, a table, a chart, a report, a graph, a log, a text document, a media file, an image, a list, and/or in any other form.

As previously mentioned, the input data from step 302 can include data defining a well path or trajectory (e.g., complex well trajectory 156). Such data can be provided in one or more forms and/or configurations. For example, the data defining the well path or trajectory can be provided or input as measured depth (MD) and true vertical depth (TVD) pairs; as MD, inclination (INC) angle, and azimuth (AZ) angle (MD-INC-AZ); as AZ-INC-TVD; as AZ-INC-DLS (Dog Leg Severity); and so forth.

Figure 4:
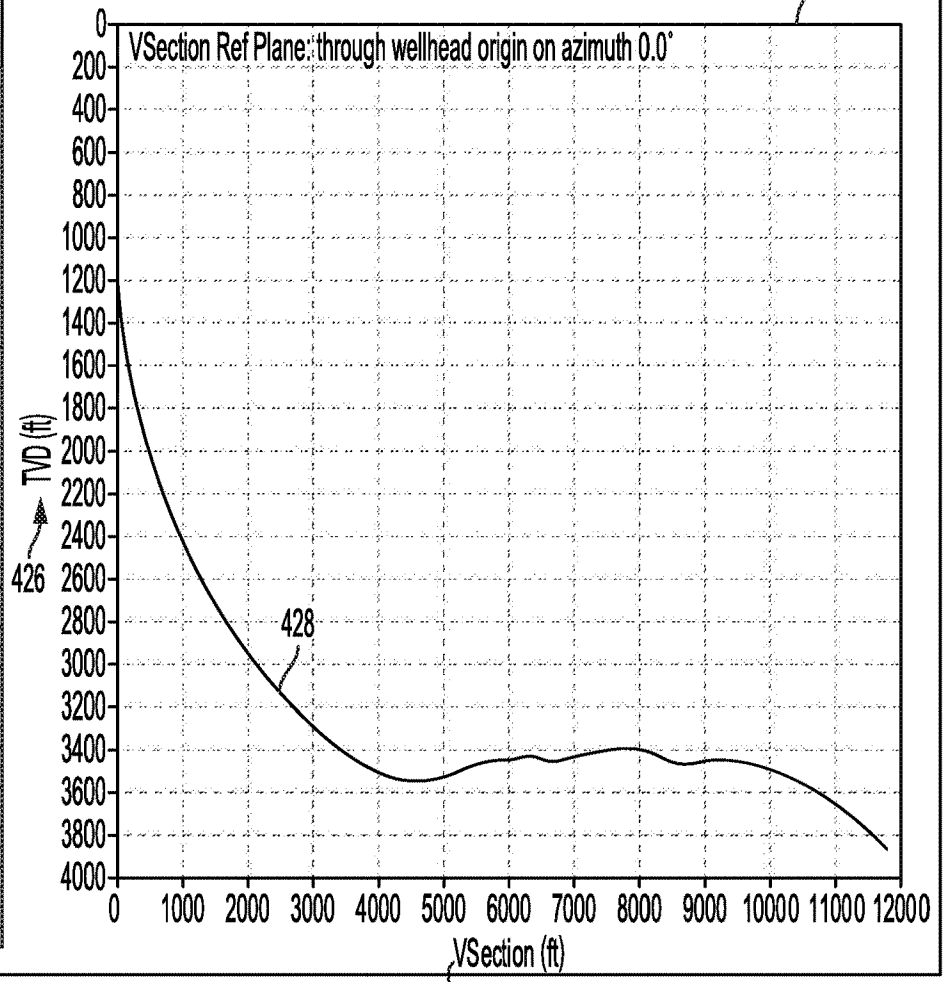
FIG. 4 is a view of an example interface for defining a complex well trajectory associated with a wellbore for design analysis and simulation, in accordance with some examples.

FIG. 4 illustrates an example interface for defining a well path or trajectory associated with a wellbore (e.g., 150). In this example, the interface includes a well path editor 402 where a user can enter values for fields 404-420 used to define a well path or trajectory. The fields 404-420 can include a data entry mode field 404, a measured depth (MD) field 406, an inclination (INC) angle field 408, an azimuth (AZ) field 410, a true vertical depth (TVD) field 412, a dog leg severity (DLS) field 414, a max DLS field 416, a vertical section (vsection) field 418, and a departure field 420.

The data entry mode field 404 allows a user to specify a specific data input mode such as MD-TVD mode, MD-INC-AZ mode, AZ-INC-TVD mode, AZ-INC-DLS mode, etc. The MD field 406 allows a user to define measure depth values for the well path, the INC field 408 allows a user to define inclination angles for the well path, the AZ field 410 allows a user to define AZ angles for the wellpath, the TVD field 412 allows a user to define true vertical depth values for the wellpath, the DLS field 414 allows a user to define dog leg severity values for the wellpath, the max DLS field 416 allows a user to define maximum dog leg severity values for the wellpath, the vsection field 418 allows a user to define vertical section values for the wellpath, and the departure field 420 allows a user to define departure values for the wellpath.

The interface in FIG. 4 also illustrates a graph 422 plotting a trajectory 428 of a wellpath along a vertical section axis 424 and a true vertical depth axis 426. The trajectory 428 of the wellpath along the vertical section axis 424 and the true vertical depth axis 426 can be based on the values entered in the well path editor 402. In particular, the trajectory 428 can plot the values in the MD field 406 and the TVD field 412 of the well path editor 402. As seen in this example, the trajectory 428 depicts an example complex trajectory including undulating sections.

Once the user has defined the complex well path (e.g., 428) in the well path editor 402, the user can define the operation types (e.g., drilling, production, etc.) for the environmental analysis and obtain the corresponding results for temperature and pressure profiles.

Figure 5:
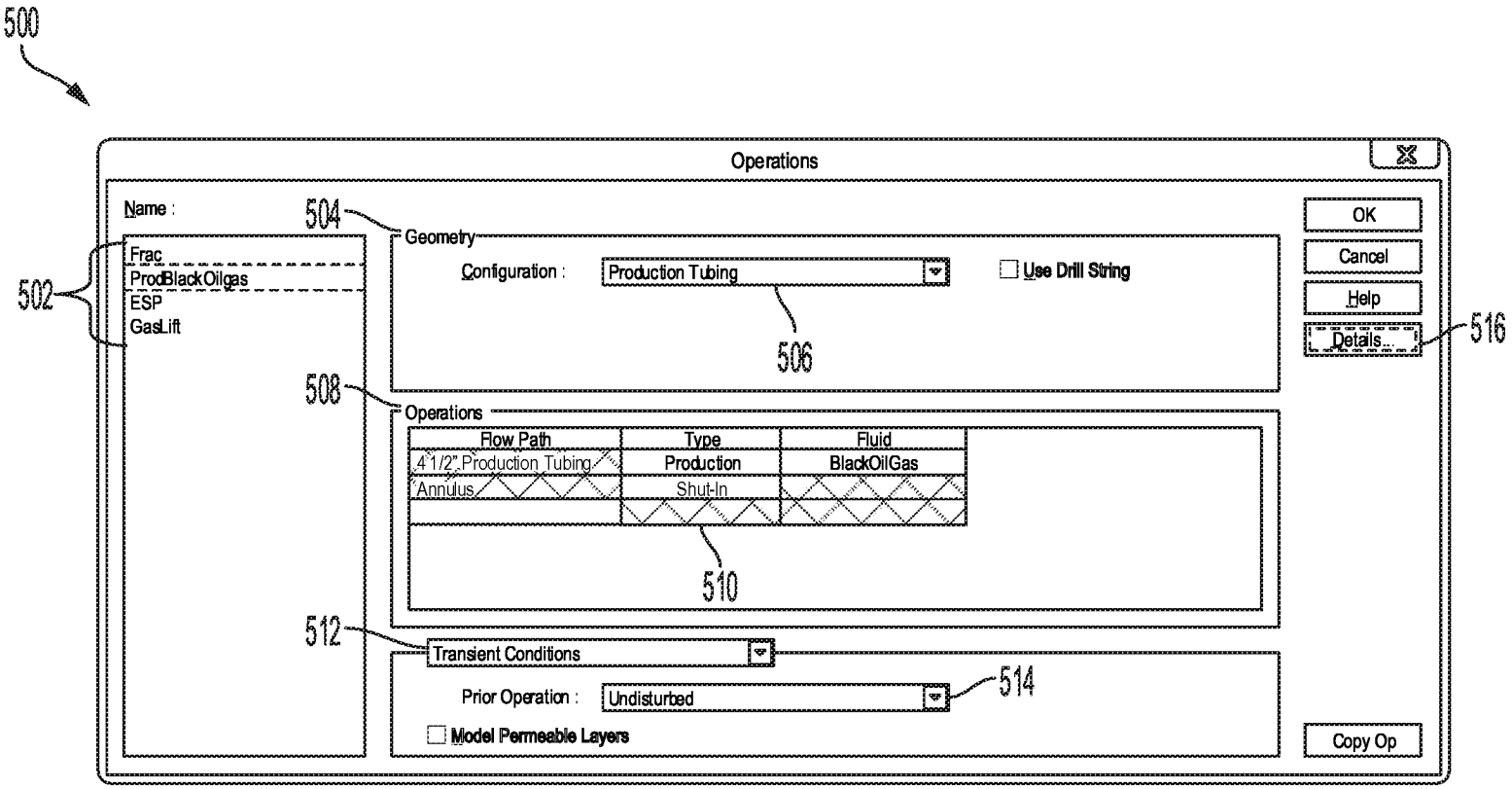
FIG. 5 is a view of an example interface for defining and managing operation types and configurations for design analysis and simulation, in accordance with some examples.

FIG. 5 illustrates an example interface 500 for defining and managing operation types and configurations. The interface 500 can include an operations section 502 where the user can select or define a particular type of operation, such as a production operation, a fracturing operation, a gas lifting operation, and so forth. In this example, the operations section 502 illustrates a production operation. The interface 500 can also include a geometry configuration section 504 where a user can provide a configuration input 506 for selecting a wellbore component associated with the selected production operation in interface 500 and/or defining a wellbore component (e.g., defining a type of wellbore component, defining a geometry and/or properties of the wellbore component, identifying the wellbore component, etc.) associated with the selected production operation in interface 500. In this example, the configuration input 506 includes a selection of a production tubing.

The interface 500 can also include an operations configuration section 508 where the user can define specific operations 510 and associated parameters. The operations 510 and associated parameters can include, for example, a flow path, an operation type, a fluid type, etc. To illustrate, in FIG. 5, the operations 510 and associated parameters define a production tubing for a first flow path, a production operation as an associated operation type, and a fluid type of black oil and gas. The operations 510 and associated parameters in this example also define an annulus for a second flow path and a shut-in operation as the associated operation type.

The interface 500 can also include a conditions field 512 and a prior operation field 514. The conditions field 512 enables a user to specify simulation conditions, such as transient conditions or steady state conditions. The prior operation field 514 enables a user to specify a prior operation as its initial condition where the result final condition of the prior operation is used as the initial condition of this current operation, such as an undisturbed operation, another defined operation, and so forth.

In some implementations, the interface 500 can include other options and/or interface elements for configuring additional details for the production operation defined in interface 500. For example, the interface can include an interface element 516 for accessing additional configuration options, expanding the interface 500 to provide additional options and/or input sections and/or fields for a user to provide additional configuration details for the production operation, or accessing a separate interface, window, and/or configuration section/panel for a user to provide additional configuration details for the production operation.

Figure 6A:
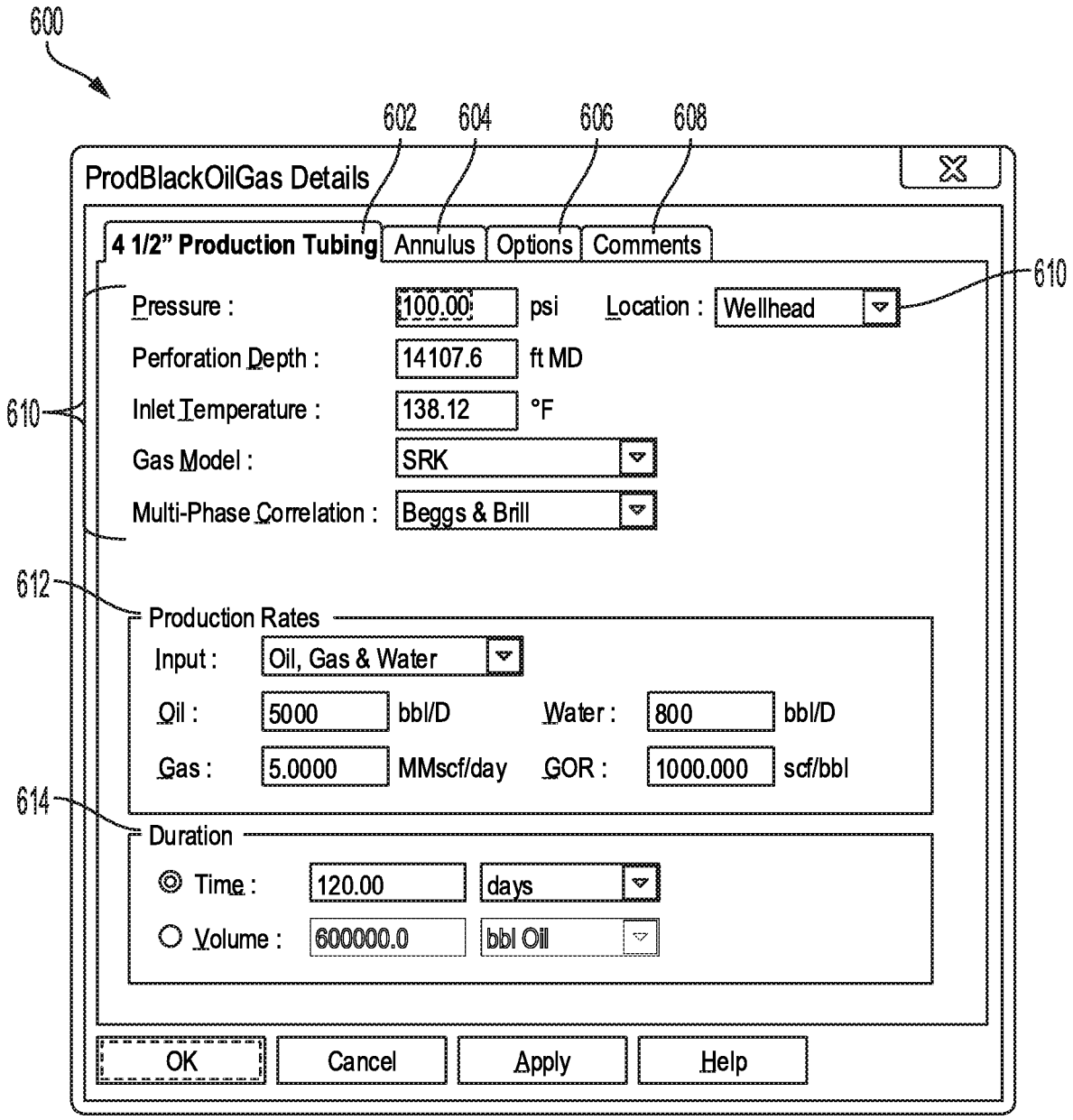
FIGS. 6A through 6D are views of example interfaces for configuring additional details, options, or parameters for an example production operation defined in the example interface shown in FIG. 5, in accordance with some examples.
Figure 6B:
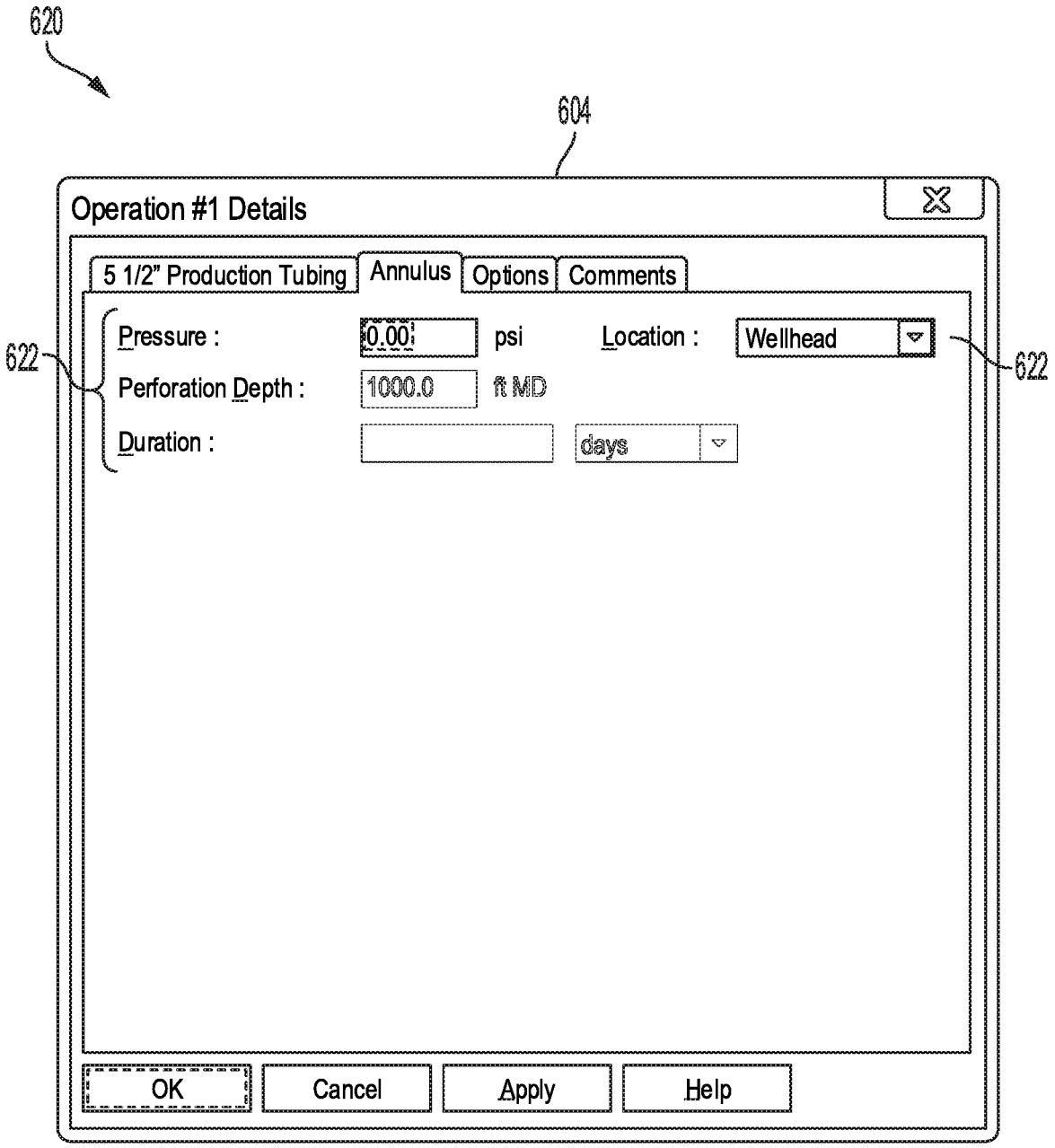

FIG. 6A illustrates an example interface 600 for configuring additional details, options, and/or parameters for the production operation defined in interface 500. In some examples, the interface 600 can be accessed through the interface element 516 on interface 500. However, one of skill in the art will recognize that other examples may provide access to the interface 600 through any other mechanism and/or from any other interface or location.

In this example, interface 600 provides a graphical window or interface where a user can configure additional details and/or parameters for the specific operations 510 defined on interface 500. The interface 600 includes a first tab 602 including configuration options associated with a first flow path (e.g., 4½" Production Tubing) defined in the operations configuration section 508 of interface 500, a second tab 604 including configuration options associated with a second flow path (e.g., Annulus) defined in the operations configuration section 508 of interface 500, an options tab 606 where a user can define additional options and/or parameters for the production operation, and a comments tab 608 where a user can provide or access comments.

The example interface 600 in FIG. 6A illustrates an example configuration of the first tab 602. As illustrated, the first tab 602 can include configuration options 610 for defining various parameters and configuration details for the flow path (e.g., 4½" Production Tubing) associated with the first tab 602. The configuration options 610 can include, for example, a pressure, a perforation depth, an inlet temperature, a gas model, a flow correlation method, a location, and/or any other configuration details. The first tab 602 can also include a production rates section 612 where a user can define a production input, such as a fluid (e.g., water, oil, etc.), a gas, and/or any other state of matter, as well as production rates for each item in the production input.

For example, as seen in FIG. 6A, the user has selected oil, gas, and water as the production input in the production rates section 612. The user has also provided respective production rates for each item in the production input (e.g., oil, gas, and water). In this example, the user has provided a volume ratio for oil (e.g., barrels per day or bbl/D), a volume ratio for water (e.g., barrels per day or bbl/D), a volume ratio for gas (e.g., million standard cubic feet per day (MMscf/D), and a gas oil ratio or GOR (e.g., standard cubic feet per barrels or scf/bbl). The production input and production rates illustrated in FIG. 6A are non-limiting examples provided for explanation purposes. One of skill in the art will recognize that other examples can provide more, less, and/or different production inputs and/or production rates (and units).

Moreover, the first tab 602 can include a duration section 614 where the user can define specific duration parameters such as duration time, volume, etc. Once the user has completed defining and/or configuring the various options and/or parameters in the first tab 602, the user can apply the settings and/or select a different tab (e.g., 604, 606, 608) to configure or modify. For example, with reference to FIG. 6B which illustrates an example view 620 of the annulus tab (e.g., second tab 604), the user can select the annulus tab (e.g., second tab 604) to configure parameters and details for the annulus.

As illustrated in the view 620 of the annulus tab (e.g., the second tab 604), the annulus tab can include configuration options 622 for defining various parameters and configuration details for the annulus. The configuration options 622 can include, for example, a pressure, a perforation depth, a duration, a location, and/or any other configuration details. Once the user has completed defining and/or configuring the configuration options 622 in the annulus tab (e.g., the second tab 604), the user can apply the settings and/or select a different tab (e.g., 606, 608) to configure or modify.

Figure 6C:
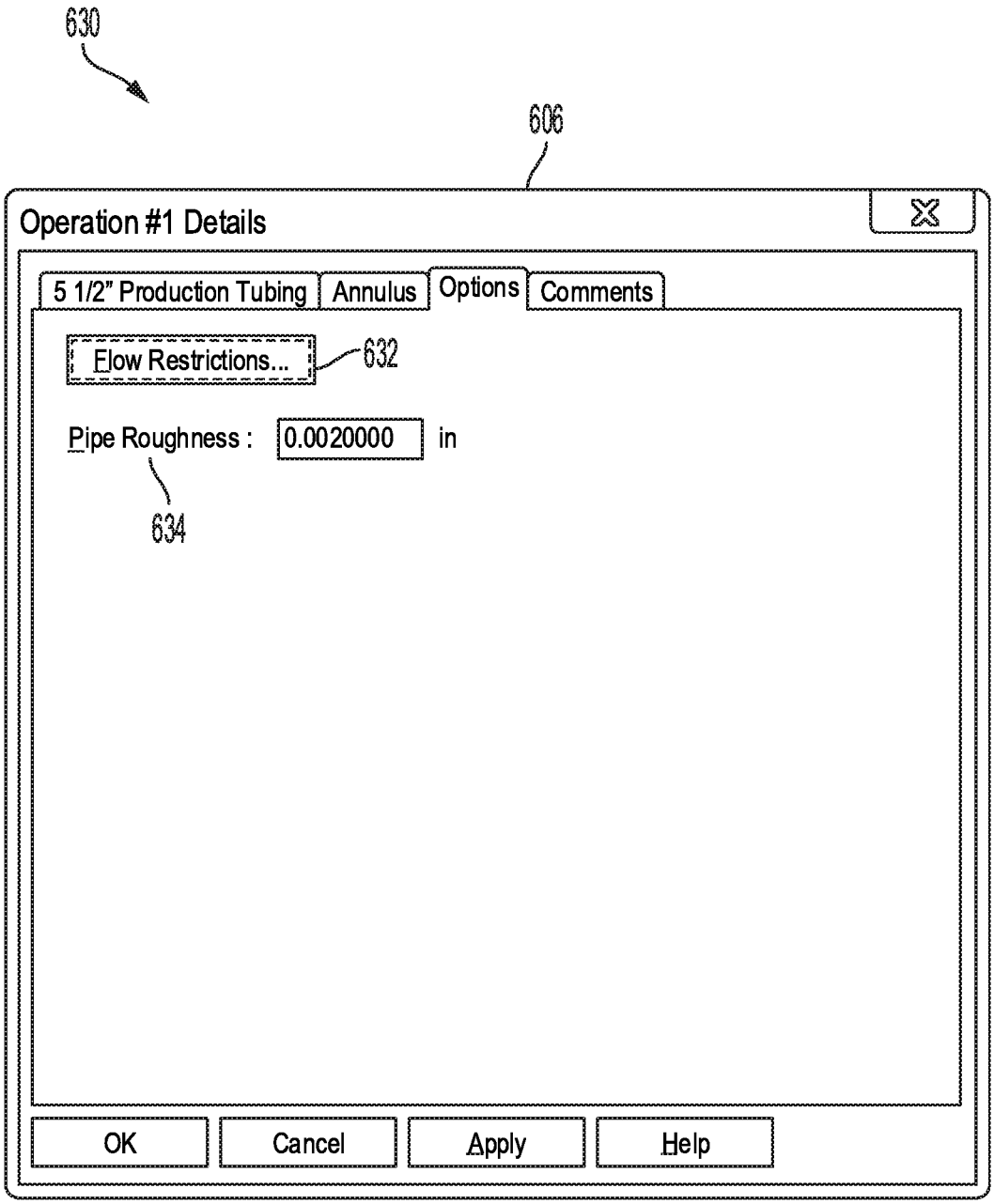
Figure 6D:
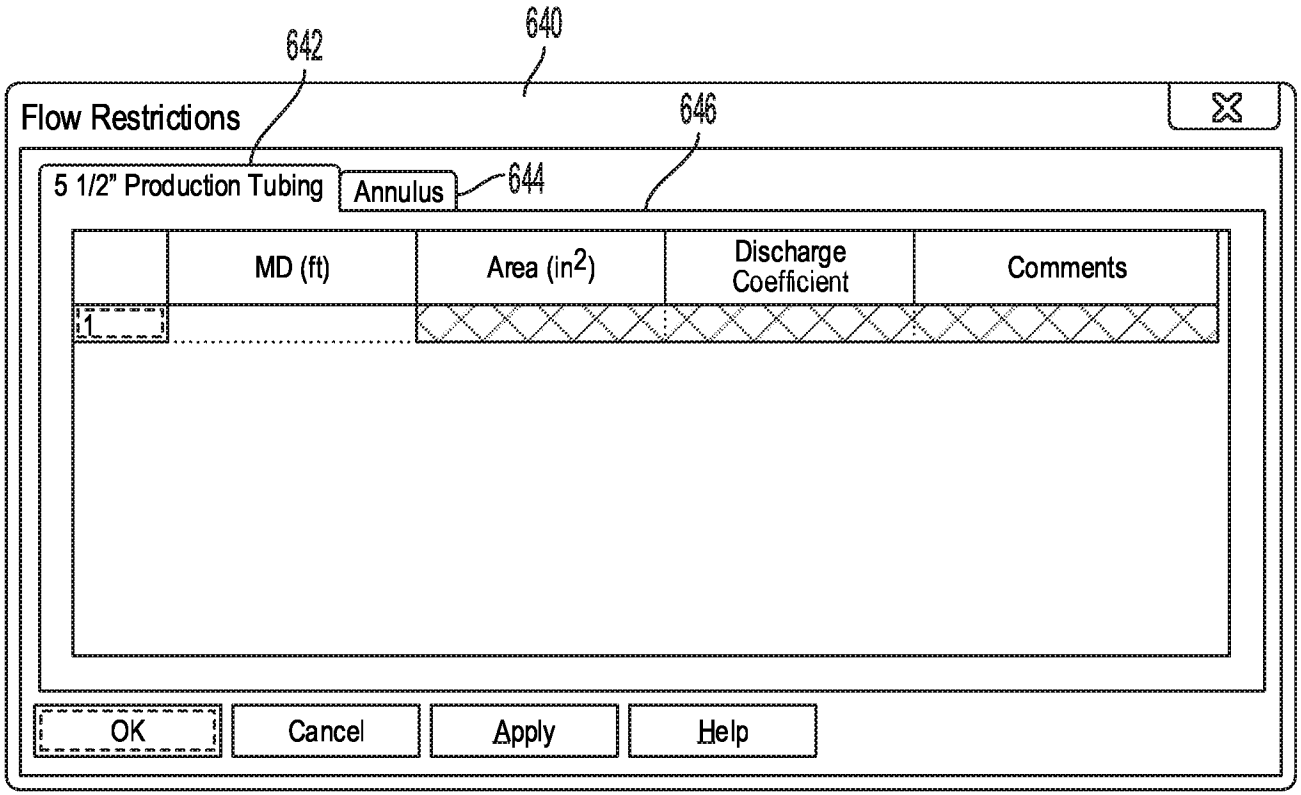

FIG. 6C illustrates an example view 630 of the options tab 606 in interface 600. The options tab 606 can include any additional configuration options for the components configured in the first and second tabs 602, 604 of the interface 600. In this example, the options tab 606 includes an interface element 632 for configuring flow restrictions for the production operation configured in the interface 600, and a configuration parameter 634 for defining a pipe roughness associated with the production tubing.

The interface element 632 element can allow a user to access a flow restrictions interface where the user can input flow restrictions and associated parameters. For example, with reference to FIG. 6D, a user can select the interface element 632 to access flow restrictions interface 640. The flow restrictions interface 640 can include a production tubing section 642 where the user can input flow restriction parameters associated with the production tubing, and an annulus section 640 where the user can similarly input flow restriction parameters associated with the annulus.

In the example view 630, the production tubing section 642 is illustrated to include configuration options 646 for defining the flow restriction parameters associated with the production tubing. The configuration options 646 can include flow restriction parameters such as, for example and without limitation, a measured depth, an area, a discharge coefficient, and/or any other flow restriction parameters or details. In some cases, the configuration options 646 can also include a field or section for providing comments in association with the flow restriction parameters.

Figure 7:
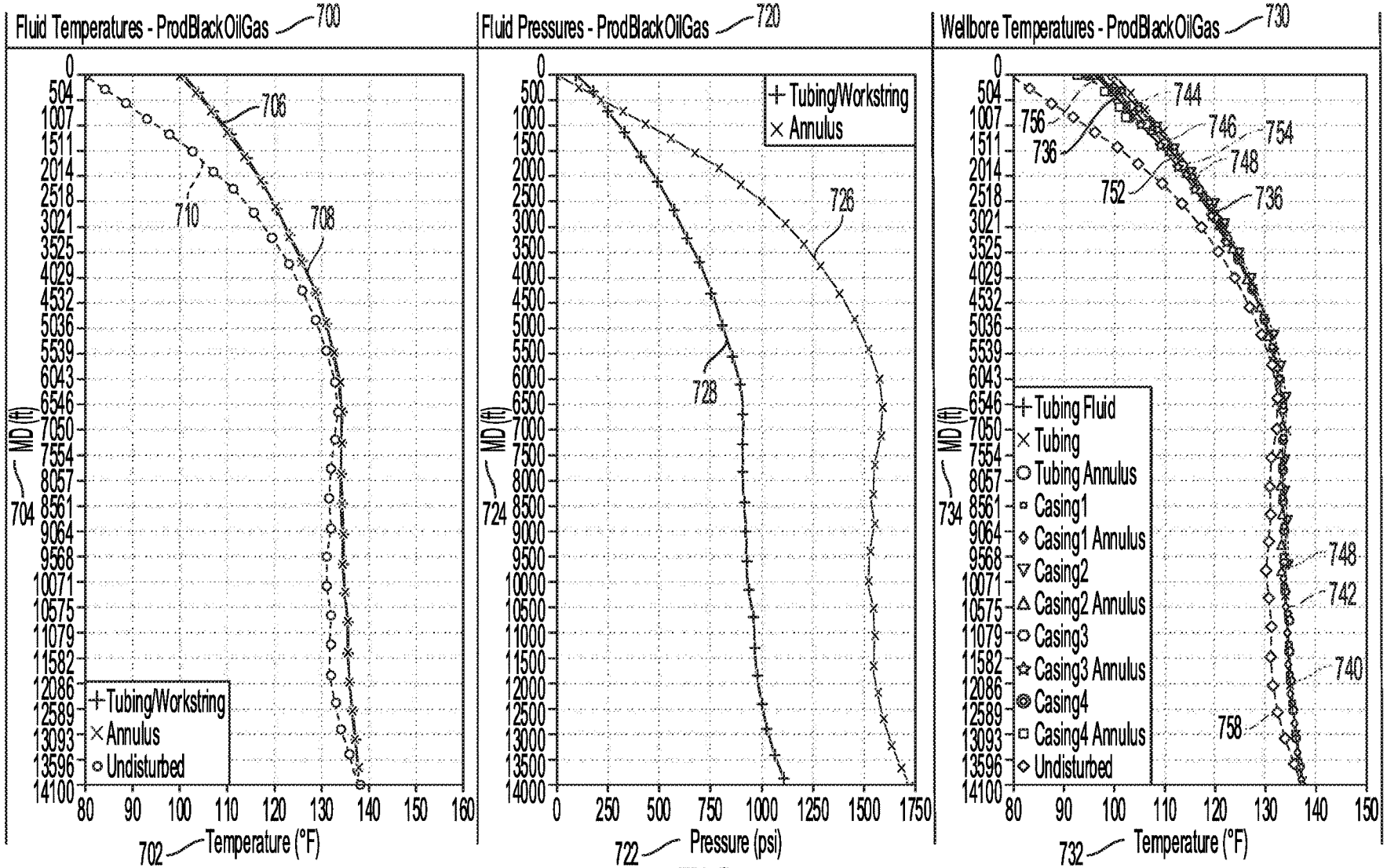
FIG. 7 illustrates charts of example temperature profiles, pressure profiles, and wellbore temperature profiles generated for a specified production operation, in accordance with some examples.

FIG. 7 illustrates example temperature profiles, pressure profiles, and wellbore temperature profiles generated for a production operation by the environmental analysis engine 204 at step 310 of the process 300 shown in FIG. 3. The temperature profiles are illustrated in a chart 700 plotting a temperature profile 706 calculated for tubing (e.g., tubular, production tubing, work string, etc.) in the wellbore (e.g., 150), a temperature profile 708 calculated for an annulus in the wellbore (e.g., 150), and an undisturbed geothermal temperature profile 710. The temperature profiles 706, 708, and 710 are plotted along an X axis 702 of temperature values and a Y axis 704 of measured depth values.

The pressure profiles are illustrated in a chart 720 plotting a pressure profile 726 calculated for tubing (e.g., tubular, production tubing, work string, etc.) in the wellbore (e.g., 150) and a pressure profile 728 calculated for the annulus in the wellbore (e.g., 150). The pressure profiles 726 and 728 are plotted along an X axis 722 of pressure values and a Y axis 724 of measured depth values.

The wellbore temperature profiles are illustrated in a chart 730 plotting wellbore temperature profiles 736-758 for the various components of the wellbore (e.g., 150). The wellbore temperature profiles 736-758 include a tubing fluid temperature profile 736, a tubing temperature profile 738, a tubing annulus temperature profile 740, a first casing temperature profile 742, a first casing annulus temperature profile 744, a second casing temperature profile 746, a second casing annulus temperature profile 748, a third casing temperature profile 750, a third casing annulus temperature profile 752, a fourth casing temperature profile 754, a fourth casing annulus temperature profile 756, and an undisturbed geothermal temperature profile 758. The wellbore temperature profiles 736-758 are plotted along an X axis 732 of temperature values and a Y axis 734 of measured depth values.

As illustrated by the plotted temperature and pressure profiles 706-710, 726-728, and 736-758, the temperatures and pressure along the wellbore, including the undisturbed geothermal temperatures, have undulating shapes or patterns. The temperature and pressure information from the temperature and pressure profiles 706-710, 726-728, and 736-758 can be used by the stress analysis engine 206 and the well system analysis engine 208 to perform the stress and well system analysis described in FIG. 3. The temperature and pressure profiles 706-710, 726-728, and 736-758 can also provide useful insight to the engineers into the temperature and pressure conditions in the wellbore.

In many cases, it can also be beneficial to the engineers to view and understand the conditions resulting from shut-in operations. For example, after a shut-in operation, gas, oil, and water often settle down and result in multiple gas-oil and oil-water interfaces in different downhill and uphill sections of the wellbore. The shut-in operation results can provide valuable insights when installing an electric downhole or submersible pump (ESP), as the engineers should avoid installing such an ESP device at a location where there is gas and no liquid (e.g., oil and/or water) present after the shut-in operation, otherwise the pump can be difficult to restart. To this end, the environmental analysis engine 204 can model the shut-in fluid (e.g., gas, oil, and water) pressure and distribution profiles. The environmental analysis engine 204 can also model the multiphase flow (e.g., gas, oil, and water), including uphill and downhill flowing and heat transfer in undulating well sections, in both transient and steady state conditions.

Figure 8:
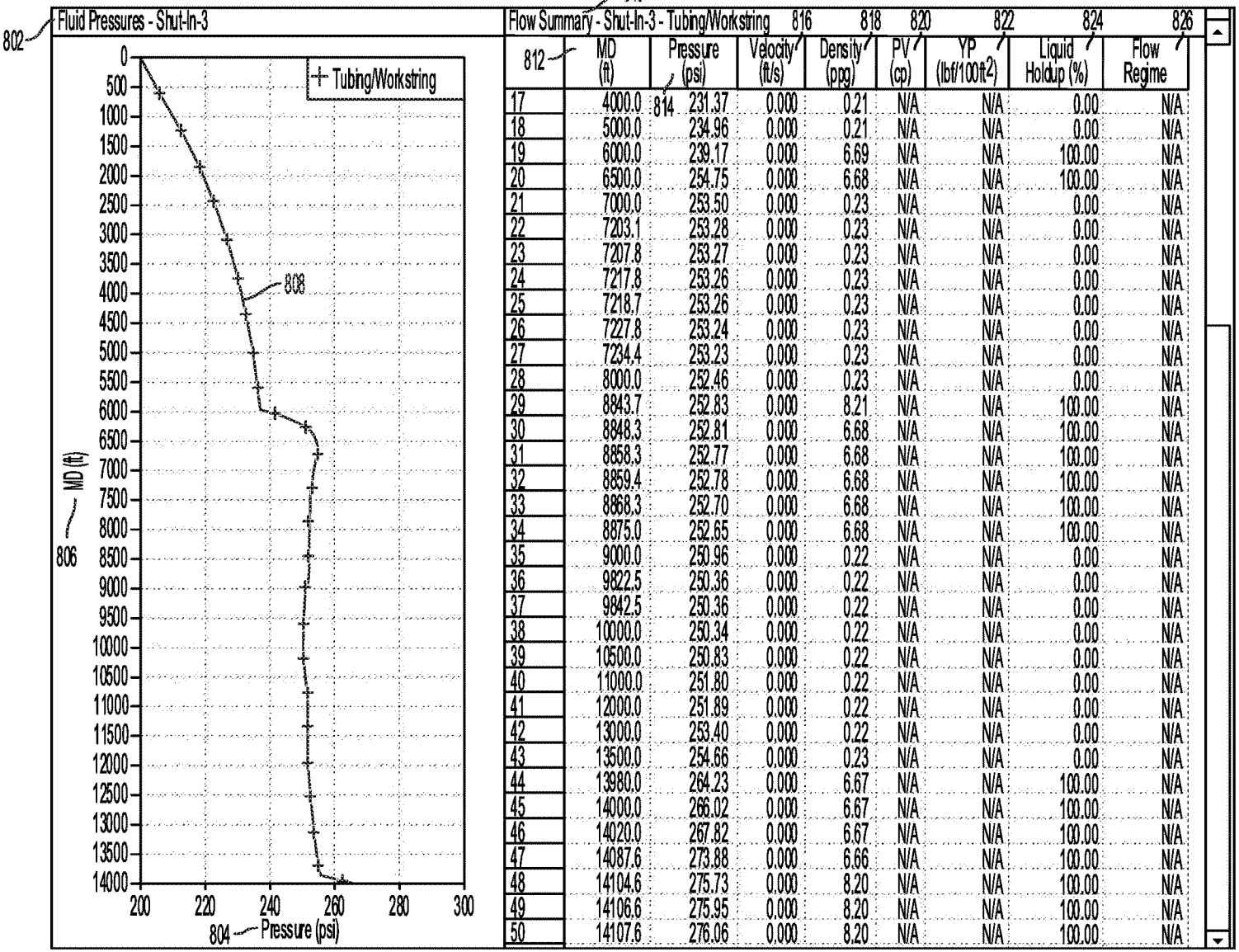
FIG. 8 is an example chart plotting a shut-in flow pressure profile (with gas/oil/water settling down effect) for tubing in a wellbore and an example flow summary for the shut-in operation, in accordance with some examples.

FIG. 8 illustrates an example chart 802 plotting a shut-in flow (e.g., gas, oil, water) pressure profile 808 for tubing in the wellbore and an example flow summary 810 for the shut-in operation. The chart 802 plots the shut-in flow pressure profile 808 along an X axis 804 of pressure values and a Y axis 806 of measured depth values. The shut-in flow pressure profile 808 in the chart 802 illustrates the fluid pressure for the tubing along different depths of the wellbore. As seen in this example, the shut-in pressure increases as the depth increases, with a portion of the plotted shut-in pressure profile 808 exhibiting undulating behavior.

The flow summary 810 for the shut-in operation depicts the flow (e.g., gas, oil, and water) distribution profile. In this example, the flow summary 810 includes a measured depth column 812 containing various measured depth values, a pressure column 814 containing pressure measurements associated with respective measured depths from the measured depth column 812, a velocity column 816 containing flow velocity measurements associated with respective measure depths from the measured depth column 812, a density column 818 containing measured density values associated with respective measure depths from the measured depth column 812, a PV column 820 containing plastic viscosity (PV) values associated with respective measure depths from the measured depth column 812, a YP column 822 containing yield point (YP) values associated with respective measure depths from the measured depth column 812, and a liquid holdup column 824 containing a percent of liquid holdup associated with respective measure depths from the measured depth column 812. Also, from the flow summary table 810, the density column 818 and liquid hold up column 824 illustrate the settling profile of the gas/oil/water in each undulating section of the wellbore.

The flow summary 810 in this example also includes a flow regime column 826 for flow regime data associated with respective measure depths from the measured depth column 812. The flow regime data can describe the geometrical distribution of the flow (e.g., gas, oil, and water) moving through the tubing at the various measured depths in the measured depth column 812. This flow regime column 826 provides the flow regime information for fluid flow, such as slug, dispersed bubble, annular, stratified-wavy, stratified-smooth, turbulent, etc., which is beneficial for multiphase flow production.

After the temperature and pressure profiles for the wellbore with the complex well trajectory (e.g., 156) are obtained by the modeling and analysis system 200 (e.g., from the environmental analysis engine 204), the modeling and analysis system 200 can analyze and/or model the casing and tubing design as affected by complex well trajectory (e.g., 156) of the wellbore and the corresponding temperature and pressure profiles as affected by the complex well trajectory (e.g., 156). In some cases, the calculation, modeling, and/or use of the temperature profiles for the casing and tubing design can be optional. However, in some cases, the temperature and pressure effects for the casing and tubing design can increase the accuracy of casing and tubing design and analysis, which can be particularly beneficial for high-pressure, high-temperature (HPHT) wells.

Figure 9:
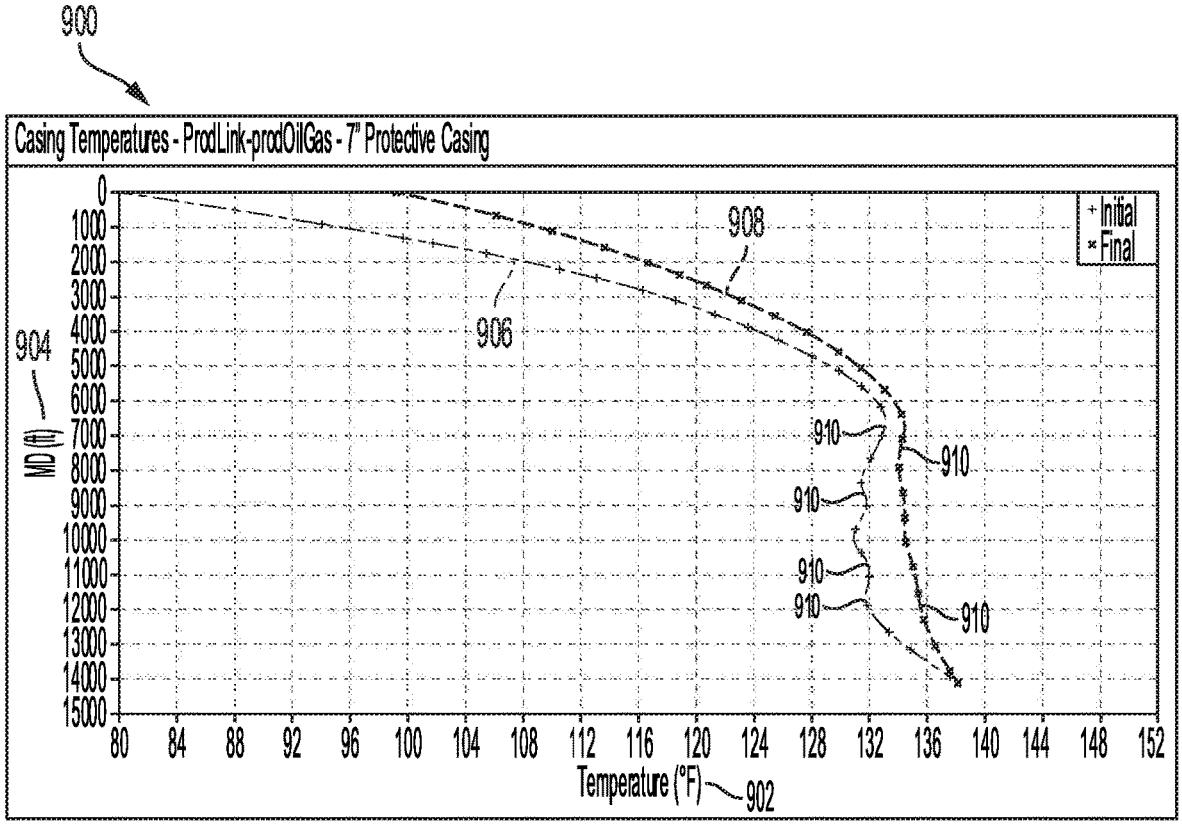
FIG. 9 is a chart depicting an example comparison of a temperature profile for a casing at an initial condition and a temperature profile for the casing at a final condition, in accordance with some examples.

FIG. 9 illustrates a chart 900 depicting an example comparison of a temperature profile 906 for the casing at an initial condition and a temperature profile 908 for the casing at a final condition. The temperature profiles 906 and 908 are plotted in the chart 900 along an X axis 902 of temperature values and a Y axis 904 of measured depth values. As illustrated by the temperature profiles 906 and 908 in the chart 900, the temperature changes from the initial condition to the final condition are irregular at the undulating sections 910. Moreover, the delta temperatures associated with the temperature profiles 906 and 908 are also undulating, which can induce different thermal expansion and/or shrinkage on the casing and additional irregular axial loads on the casing.

Figure 10A:
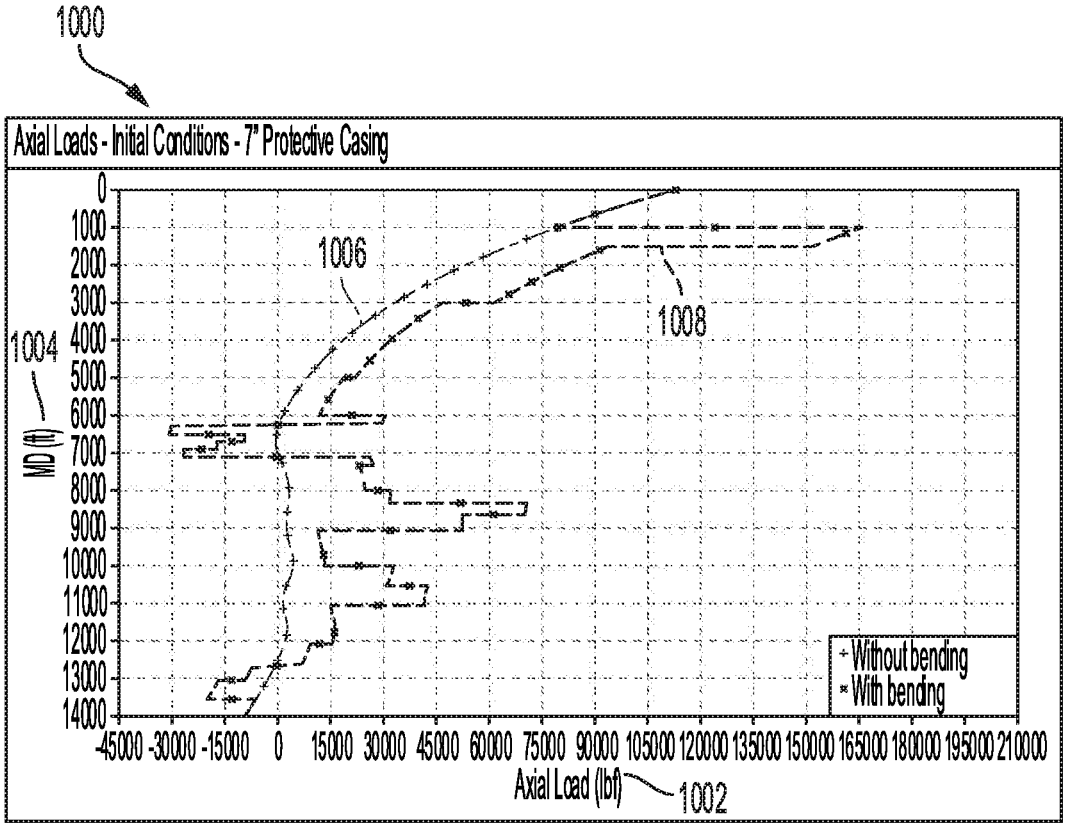
FIG. 10A is a chart depicting example axial load profiles for a casing at an initial condition, in accordance with some examples.
Figure 10B:
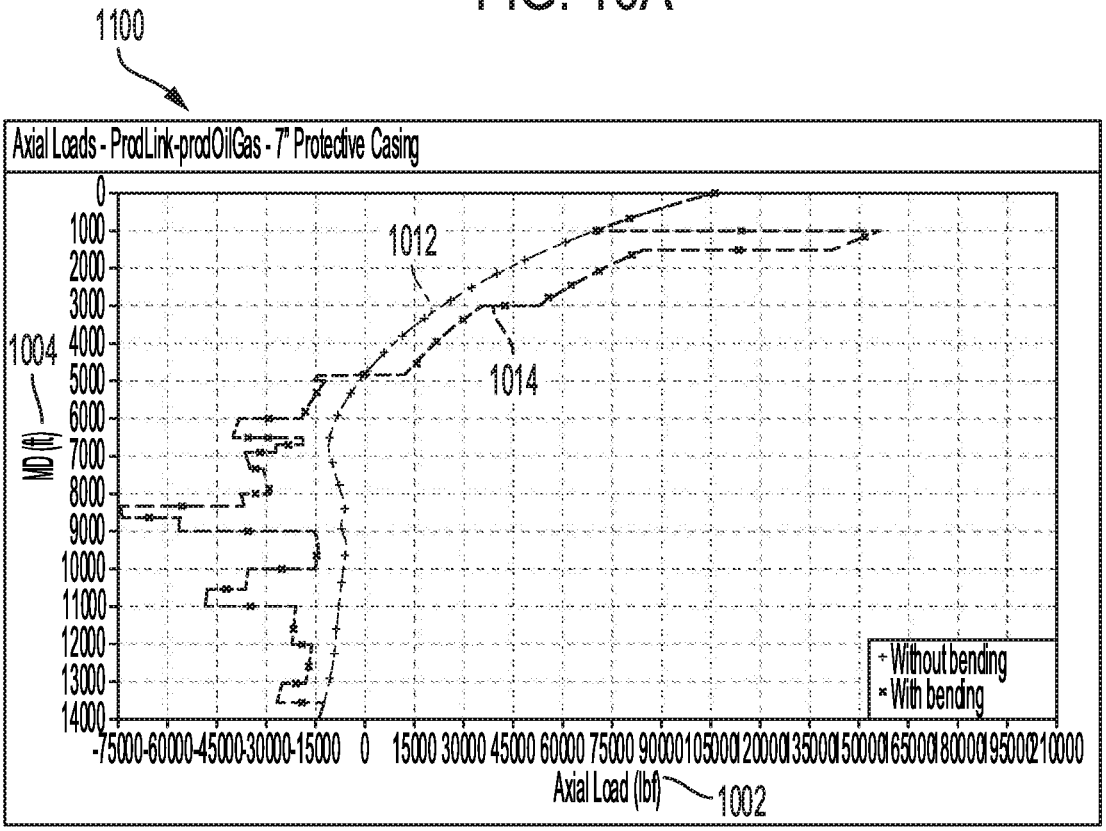
FIG. 10B is a chart depicting example axial load profiles for a casing at a final condition, in accordance with some examples.

FIGS. 10A and 10B illustrate an example of undulations inducing additional bending stress on the axial load of the casing, which can be accurately calculated by the approaches described herein. With reference to FIG. 10A, a chart 1000 depicts example axial load profiles 1006 and 1008 for the casing at an initial condition. The axial load profiles 1006 and 1008 can be calculated by the stress analysis engine 206 as described with respect to step 312 shown in FIG. 3.

Moreover, the axial load profile 1006 represents the axial load on the casing without such bending stress and the axial load profile 1008 represents the axial load on the casing with such bending stress. The axial load profiles 1006 and 1008 are plotted in the chart 1000 along an X axis 1002 of axial load values and a Y axis 1004 of measured depth values.

As illustrated in the chart 1000, the axial load at the initial condition reflects part of the undulating sections in a compression condition and part of the undulating sections in a tension condition. The compression and tension conditions can depend on the complexity of the well and the undulating conditions, as well as the load condition, such as buckling effect.

With reference to FIG. 10B, a chart 1010 depicts example axial load profiles 1012 and 1014 for the casing at a final condition. The axial load profiles 1012 and 1014 can be calculated by the stress analysis engine 206 as described with respect to step 312 shown in FIG. 3. Moreover, the axial load profile 1012 represents the axial load on the casing without such bending stress and the axial load profile 1014 represents the axial load on the casing with such bending stress, where the bending stress is from the combined effect of the undulating condition and the effect of the load condition such as buckling. The axial load profiles 1012 and 1014 are plotted in the chart 1010 along the X axis 1002 of axial load values and the Y axis 1004 of measured depth values.

As seen in FIG. 10B, the axial load profiles 1012 and 1014 at the final condition reflect the additional effect of the temperature calculated by the environmental analysis engine 204. The comparison of the axial load profiles 1012 and 1014 illustrate temperature changes inducing more compression along the string and a longer portion of the string being compressed.

As previously explained, the well system analysis performed by the well system analysis engine 208 can include calculating the trapped annular pressure buildup (APB) and trapped annular fluid expansion (AFE) for a wellbore with a complex well trajectory (e.g., 156). FIG. 11 illustrates a table 1100 of example APB and AFE calculation results from the well system analysis (e.g., 314) performed by the well system analysis engine 208 for a wellbore with a complex well trajectory.

In this example, the table 1100 provides a multi-string annular fluid expansion summary for an oil-gas production operation, where the well is heated causing the fluid trapped in the annular space to be heated and expanded inducing additional pressure on each annulus. The well system analysis engine 208 can accurately calculate the increases in the APB and AFE on each annulus. Moreover, the additional pressure can be applied to further analyze the stress conditions and/or properties for the string of the casing and tubing in a point of view of a well system environment.

The table 1100 includes a string annulus column 1102 defining different associated components analyzed, which in this example include an intermediate casing, a drilling casing, a protecting casing, and a production tubing. The table 1100 also includes a region column 1104 showing the top and base of each trapped annulus space of the well for each component in column 1102, a device failure column 1106 defining any disk and foam failures associated with each component in column 1102, an AFE pressure column 1108 showing the calculated incremental pressure changes due to APB associated with each component in column 1102, and an AFE volume column 1110 showing the incremental volume changes due to APB associated with each component in column 1102.

In some cases, the incremental pressure changes in the AFE pressure column 1108 of the table 1100 can be caused by the annular fluid expansion, which is shown in the incremental AFE volume column 1110 of the table 1100. After obtaining the APB and AFE calculations, the additional pressure calculated can be applied to the string for a stress analysis; a different worst condition analysis can be considered, such as maximum burst condition, a maximum collapse condition, etc.; and a combined APB analysis performed.

Figure 12:
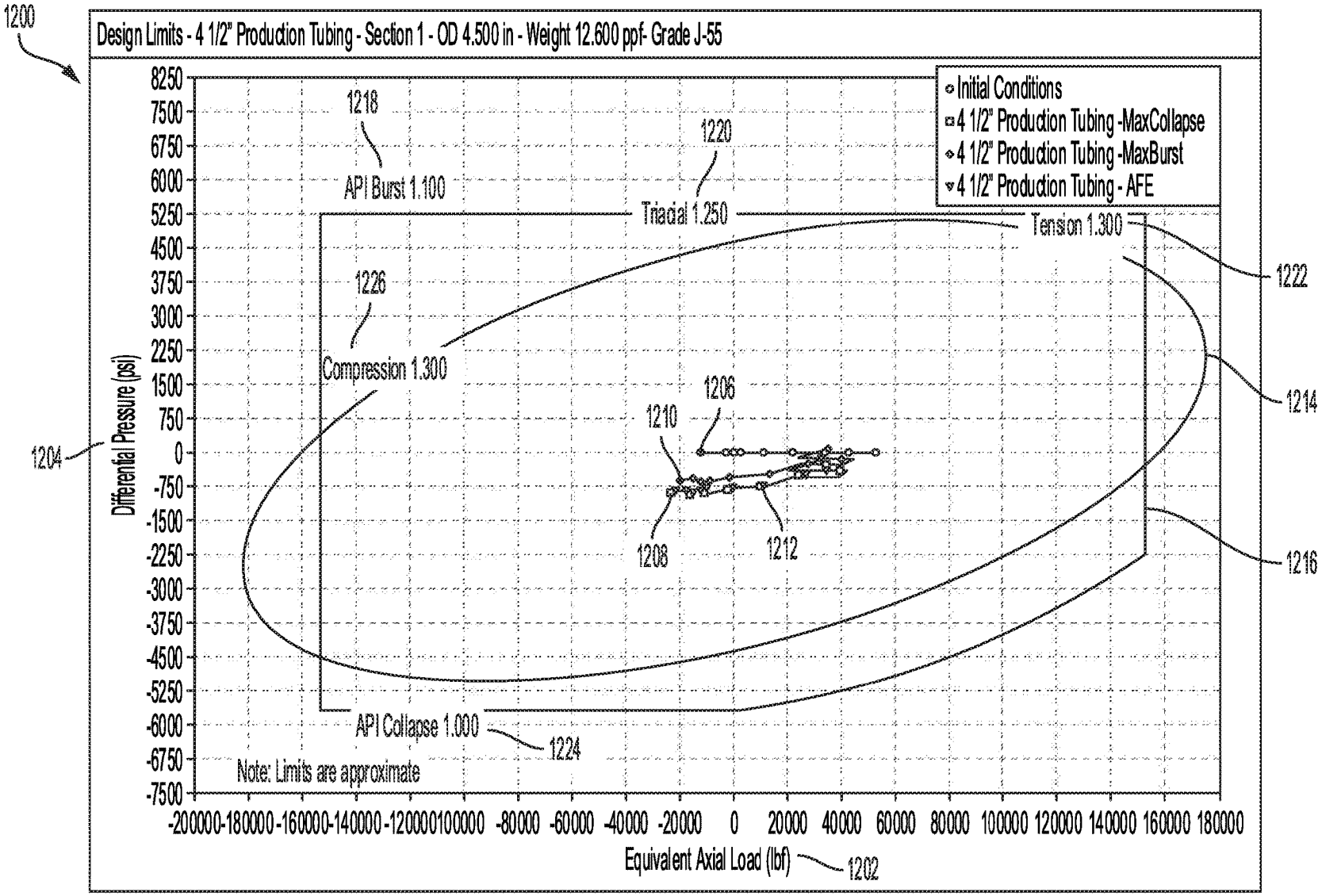
FIG. 12 is a chart plotting example design limits calculated for an example tubing in a wellbore with a complex well trajectory, in accordance with some examples.

FIG. 12 illustrates a chart 1200 plotting example design limits calculated by the modeling and analysis system 200 (e.g., via the well system analysis engine 208) for an example tubing in a wellbore (e.g., 150) with a complex well trajectory (e.g., 156). The chart 1200 plots different worst or maximum load case scenarios for the tubing, including a maximum collapse load 1208, a maximum burst load 1210, and the load with AFE effect 1212.

The maximum collapse load 1208 is plotted along specific equivalent axial load values 1202 (X axis) and differential pressure values 1204 (Y axis). The maximum burst load 1210 and the load with AFE effect 1212 are similarly plotted along specific equivalent axial load values 1202 and differential pressure values 1204. The chart 1200 also plots initial conditions along specific equivalent axial load values 1202 and differential pressure values 1204.

The chart 1200 further plots a design limit boundary 1216 along the equivalent axial load values 1202 and the differential pressure values 1204. The design limit boundary 1216 is plotted according to various safety factors and/or criteria. In this example, the safety factors and/or criteria include an API burst factor 1218, a triaxial factor 1220, a tension factor 1222, an API collapse factor 1224 and a compression factor 1226. The chart 1200 also plots a triaxial load boundary 1214 along the equivalent axial load values 1202 and the differential pressure values 1204. The string associated with the wellbore is estimated to be safe when the plotted load cases (e.g., 1208-1212) are within the design limit boundary 1216 and the triaxial load boundary 1214.

Figure 13:
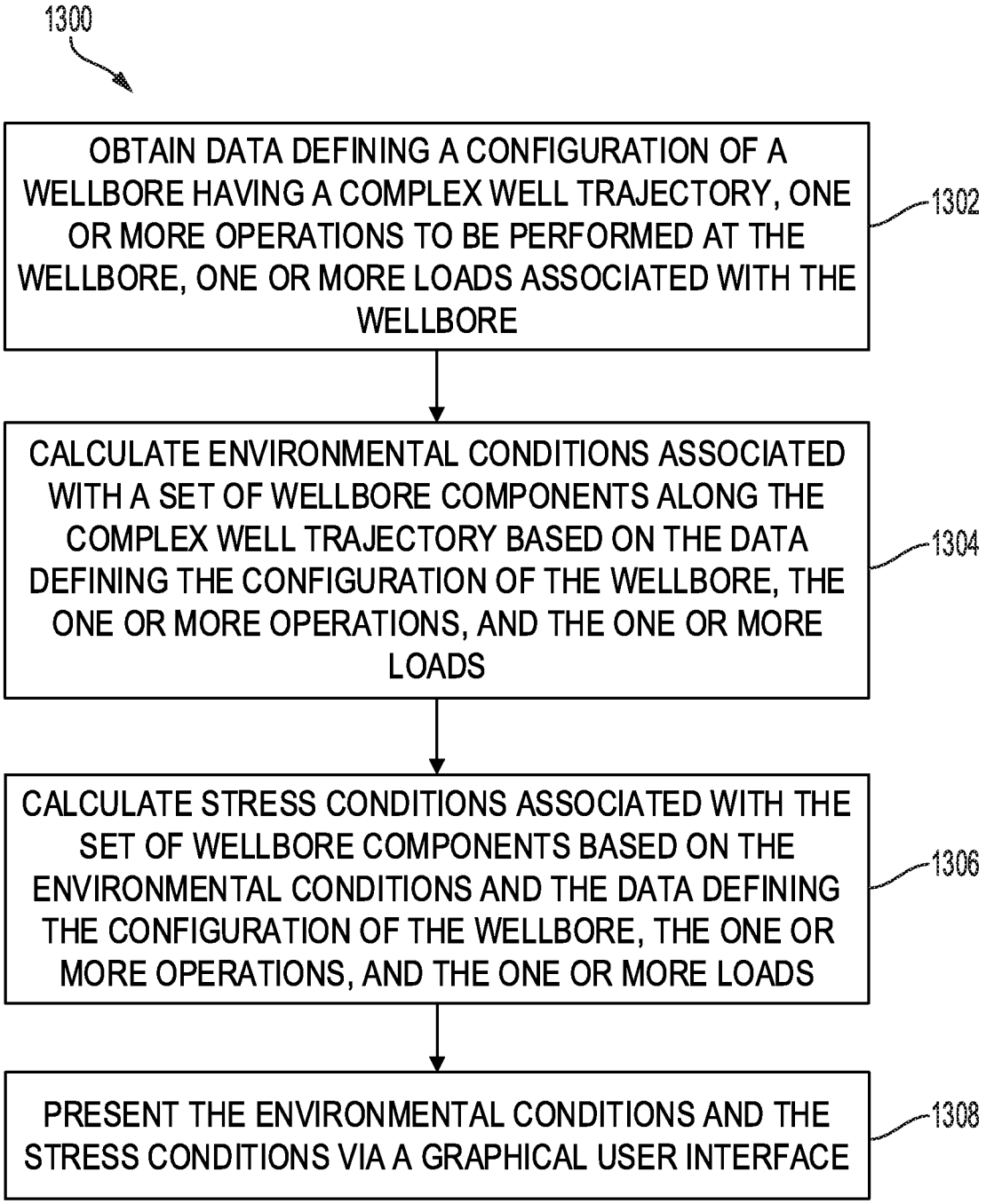
FIG. 13 is a flowchart of an example method for performing hydraulic, environmental, and mechanical design analysis and simulation for complex well trajectories, in accordance with some examples.
Figure 14:
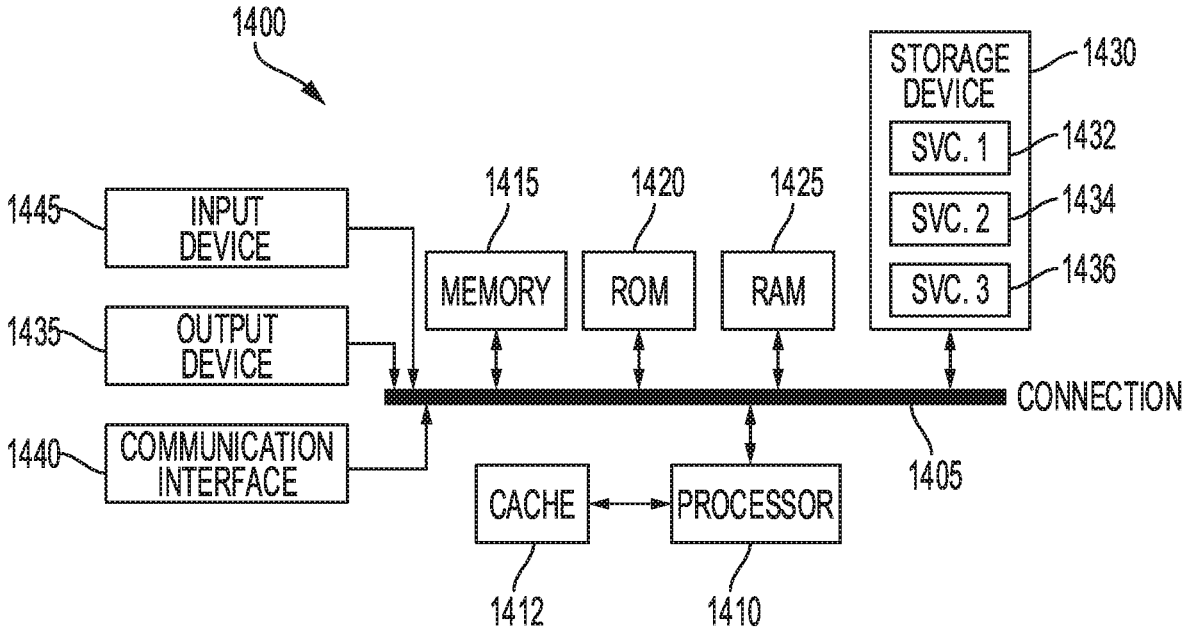
FIG. 14 is a schematic diagram of an example computing device architecture, in accordance with some examples.

Having disclosed some basic system components and concepts, the disclosure now turns to FIG. 13, which illustrates an example method 1300 for performing hydraulic, environmental, and mechanical design analysis and simulation for complex well trajectories. The steps outlined herein are exemplary and can be implemented in any combination thereof, including combinations that exclude, add, or modify certain steps.

At step 1302, the modeling and analysis system 200 can obtain data defining a configuration of a wellbore (e.g., 150) having a complex well trajectory (e.g., 156), one or more operations to be performed at the wellbore, and one or more loads associated with the wellbore. The complex well trajectory can include one or more undulating sections. The one or more operations can include, for example and without limitation, a fracturing operation, an injection operation, a production operation, a circulation operation, a drilling operation, a cementing operation, a logging operation, a casing operation, etc.

Moreover, the configuration of the wellbore can include, for example and without limitation, a well path configuration (e.g., a measured depth, a true vertical depth, an inclination angle, an azimuth angle, a dog leg severity, a maximum dog leg severity, a departure, wellbore properties, etc.) representing the complex well trajectory; a casing configuration; a tubing configuration; formation and properties around the wellbore; fluid properties; geothermal properties associated with the wellbore; flowrate properties; an inlet temperature; flow direction; a reference pressure and location; mechanical properties associated with the wellbore; a depth associated with the wellbore, the one or more operations, and/or wellbore components associated with the wellbore; etc.

In some cases, the data can include and/or define a load type associated with the one or more loads, a type of operation associated with the one or more operations, one or more parameters (e.g., configuration parameters, depth parameters, wellhead installation parameters, environmental parameters, load parameters, etc.) of a multi-string system associated with the wellbore, a load sequence associated with the one or more operations, a load history associated with the multi-string system, an initial load condition, and a final load condition resulting from the one or more operations, etc. The multi-string system can include at least a portion of a set of wellbore components associated with the wellbore, such as a casing, an annulus, a liner, a string, a multi-string system, tubing, etc.

At step 1304, the modeling and analysis system 200 can calculate environmental conditions associated with a set of wellbore components along the complex well trajectory based on the data defining the configuration of the wellbore, the one or more operations, and the one or more loads. In some examples, the environmental conditions can include temperature and pressure profiles at various locations and/or components in the wellbore. The environmental conditions (e.g., temperature and pressure profiles) can be calculated to account for an effect of the complex well trajectory on the environmental conditions.

In some cases, at step 1304, the modeling and analysis system 200 can calculate a fluid flow and heat transfer associated with the one or more operations and/or one or more types of fluid used during a life cycle of the wellbore, a temperature profile for one or more well components, a pressure profile for one or more well components, a flowstream temperature profile, a flowstream pressure profile, and/or any other flow or environmental conditions associated with the wellbore.

At step 1306, the modeling and analysis system 200 can calculate stress conditions associated with the set of wellbore components along the complex well trajectory based on the environmental conditions (e.g., temperature and pressure profiles, fluid flow, heat transfer, etc.) and the data defining the configuration of the wellbore, the one or more operations, and the one or more loads. The modeling and analysis system 200 can calculate the stress conditions to account for an effect of the complex well trajectory on the stress, load, and/or safety conditions. In some cases, the modeling and analysis system 200 can calculate stress conditions for a subset of wellbore components (e.g., a string, a casing, a multi-string system, a liner, tubing, etc.). Further, in some cases, the modeling and analysis system 200 can calculate stress conditions for all wellbore components and/or the entire wellbore environment.

In some cases, at step 1306, the modeling and analysis system 200 can calculate one or more design limits (e.g., maximum collapse, maximum burst, load with AFE/APB effect, etc.) associated with one or more wellbore components; one or more safety factors (e.g., a burst safety factor, a triaxial safety factor, a tension safety factor, a collapse safety factor, an axial safety factor, a length change associated with one or more wellbore components, a casing wear allowance, a compression safety factor, etc.); a wellhead movement; a displacement associated with one or more wellbore components; a trapped annular pressure buildup (APB) and/or a trapped annular fluid expansion (AFE) associated with the wellbore, a multi-string system associated with the wellbore, and/or one or more wellbore components; etc. The one or more design limits can be based on a load, a pressure, one or more safety factors, a temperature, mechanical properties, an operation, fluid properties (e.g., density, viscosity, liquid hold up, flow regime, etc.), movement, stress, safety factors, displacement, and so forth.

At step 1308, the modeling and analysis system 200 can present the environmental conditions and the stress conditions via a graphical user interface. The modeling and analysis system 200 can display the environmental conditions and the stress conditions in any configuration or format. For example, the modeling and analysis system 200 can display the environmental conditions and/or the stress conditions as or in a file (e.g., a spreadsheet, a text document, etc.), a graphic or image, a video, a chart, a graph, a table, a list, etc. The environmental conditions presented by the modeling and analysis system 200 can include, for example, one or more pressure and temperature profiles associated with the wellbore, heat transfer calculation results, fluid flow calculation results, initial and final conditions (e.g., temperature changes, pressure changes, etc.), and so forth.

Moreover, the stress conditions presented by the modeling and analysis system 200 can include, for example, one or more design limits, safety factors (e.g., axial, triaxial, collapse, burst, compression, tension, etc.), displacement conditions, length changes, wellhead movements, trapped APB, AFE, loads, stress results, fluid properties (e.g., viscosity, density, flow regime, liquid hold up, etc.), initial and final conditions (e.g., temperature changes, pressure changes, load changes, and so forth.

In some implementations, the modeling and analysis system 200 can generate a simulation of the environmental conditions and the stress conditions and use the simulation of the environmental conditions and the stress conditions to design the wellbore and/or one or more wellbore components, calculate the environmental conditions, and calculate the stress conditions, plan one or more wellbore operations, analyze one or more wellbore operations, etc.

In some cases, the modeling and analysis system 200 can present the environmental conditions, the stress conditions, and/or any of the data or calculations described herein on a display device at the modeling and analysis system 200. In other cases, the modeling and analysis system 200 can provide such information to a remote device for storage and/or display.

Having disclosed example systems, methods, and technologies for performing hydraulic, environmental, and mechanical design analysis and simulation for complex well trajectories, the disclosure now turns to FIG. 14, which illustrates an example computing device architecture 1400 which can be employed to perform various steps, methods, and techniques disclosed herein. The various implementations will be apparent to those of ordinary skill in the art when practicing the present technology. Persons of ordinary skill in the art will also readily appreciate that other system implementations or examples are possible.

As noted above, FIG. 14 illustrates an example computing device architecture 1400 of a computing device which can implement the various technologies and techniques described herein. For example, the computing device architecture 1400 can implement the modeling and analysis system 200 shown in FIG. 2 and perform various steps, methods, and techniques disclosed herein, such as one or more steps of the process 300 shown in FIG. 3 and/or the method 1300 shown in FIG. 13. The components of the computing device architecture 1400 are shown in electrical communication with each other using a connection 1405, such as a bus. The example computing device architecture 1400 includes a processing unit (CPU or processor) 1410 and a computing device connection 1405 that couples various computing device components including the computing device memory 1415, such as read only memory (ROM) 1420 and random access memory (RAM) 1425, to the processor 1410.

The computing device architecture 1400 can include a cache of high-speed memory connected directly with, in close proximity to, or integrated as part of the processor 1410. The computing device architecture 1400 can copy data from the memory 1415 and/or the storage device 1430 to the cache 1412 for quick access by the processor 1410. In this way, the cache can provide a performance boost that avoids processor 1410 delays while waiting for data. These and other modules can control or be configured to control the processor 1410 to perform various actions. Other computing device memory 1415 may be available for use as well. The memory 1415 can include multiple different types of memory with different performance characteristics. The processor 1410 can include any general purpose processor and a hardware or software service, such as service 1 1432, service 2 1434, and service 3 1436 stored in storage device 1430, configured to control the processor 1410 as well as a special-purpose processor where software instructions are incorporated into the processor design. The processor 1410 may be a self-contained system, containing multiple cores or processors, a bus, memory controller, cache, etc. A multi-core processor may be symmetric or asymmetric.

To enable user interaction with the computing device architecture 1400, an input device 1445 can represent any number of input mechanisms, such as a microphone for speech, a touch-sensitive screen for gesture or graphical input, keyboard, mouse, motion input, speech and so forth. An output device 1435 can also be one or more of a number of output mechanisms known to those of skill in the art, such as a display, projector, television, speaker device, etc. In some instances, multimodal computing devices can enable a user to provide multiple types of input to communicate with the computing device architecture 1400. The communications interface 1440 can generally govern and manage the user input and computing device output. There is no restriction on operating on any particular hardware arrangement and therefore the basic features here may easily be substituted for improved hardware or firmware arrangements as they are developed.

Storage device 1430 is a non-volatile memory and can be a hard disk or other types of computer readable media which can store data that are accessible by a computer, such as magnetic cassettes, flash memory cards, solid state memory devices, digital versatile disks, cartridges, random access memories (RAMs) 1425, read only memory (ROM) 1420, and hybrids thereof. The storage device 1430 can include services 1432, 1434, 1436 for controlling the processor 1410. Other hardware or software modules are contemplated. The storage device 1430 can be connected to the computing device connection 1405. In one aspect, a hardware module that performs a particular function can include the software component stored in a computer-readable medium in connection with the necessary hardware components, such as the processor 1410, connection 1405, output device 1435, and so forth, to carry out the function.

For clarity of explanation, in some instances the present technology may be presented as including individual functional blocks including functional blocks comprising devices, device components, steps or routines in a method embodied in software, or combinations of hardware and software.

In some embodiments the computer-readable storage devices, mediums, and memories can include a cable or wireless signal containing a bit stream and the like. However, when mentioned, non-transitory computer-readable storage media expressly exclude media such as energy, carrier signals, electromagnetic waves, and signals per se.

Methods according to the above-described examples can be implemented using computer-executable instructions that are stored or otherwise available from computer readable media. Such instructions can include, for example, instructions and data which cause or otherwise configure a general purpose computer, special purpose computer, or a processing device to perform a certain function or group of functions. Portions of computer resources used can be accessible over a network. The computer executable instructions may be, for example, binaries, intermediate format instructions such as assembly language, firmware, source code, etc. Examples of computer-readable media that may be used to store instructions, information used, and/or information created during methods according to described examples include magnetic or optical disks, flash memory, USB devices provided with non-volatile memory, networked storage devices, and so on.

Devices implementing methods according to these disclosures can include hardware, firmware and/or software, and can take any of a variety of form factors. Typical examples of such form factors include laptops, smart phones, small form factor personal computers, personal digital assistants, rackmount devices, standalone devices, and so on. Functionality described herein also can be embodied in peripherals or add-in cards. Such functionality can also be implemented on a circuit board among different chips or different processes executing in a single device, by way of further example.

The instructions, media for conveying such instructions, computing resources for executing them, and other structures for supporting such computing resources are example means for providing the functions described in the disclosure.

In the foregoing description, aspects of the application are described with reference to specific embodiments thereof, but those skilled in the art will recognize that the application is not limited thereto. Thus, while illustrative embodiments of the application have been described in detail herein, it is to be understood that the disclosed concepts may be otherwise variously embodied and employed, and that the appended claims are intended to be construed to include such variations, except as limited by the prior art. Various features and aspects of the above-described subject matter may be used individually or jointly. Further, embodiments can be utilized in any number of environments and applications beyond those described herein without departing from the broader spirit and scope of the specification. The specification and drawings are, accordingly, to be regarded as illustrative rather than restrictive. For the purposes of illustration, methods were described in a particular order. It should be appreciated that in alternate embodiments, the methods may be performed in a different order than that described.

Where components are described as being "configured to" perform certain operations, such configuration can be accomplished, for example, by designing electronic circuits or other hardware to perform the operation, by programming programmable electronic circuits (e.g., microprocessors, or other suitable electronic circuits) to perform the operation, or any combination thereof.

The various illustrative logical blocks, modules, circuits, and algorithm steps described in connection with the examples disclosed herein may be implemented as electronic hardware, computer software, firmware, or combinations thereof. To clearly illustrate this interchangeability of hardware and software, various illustrative components, blocks, modules, circuits, and steps have been described above generally in terms of their functionality. Whether such functionality is implemented as hardware or software depends upon the particular application and design constraints imposed on the overall system. Skilled artisans may implement the described functionality in varying ways for each particular application, but such implementation decisions should not be interpreted as causing a departure from the scope of the present application.

The techniques described herein may also be implemented in electronic hardware, computer software, firmware, or any combination thereof. Such techniques may be implemented in any of a variety of devices such as general purposes computers, wireless communication device handsets, or integrated circuit devices having multiple uses including application in wireless communication device handsets and other devices. Any features described as modules or components may be implemented together in an integrated logic device or separately as discrete but interoperable logic devices. If implemented in software, the techniques may be realized at least in part by a computer-readable data storage medium comprising program code including instructions that, when executed, performs one or more of the method, algorithms, and/or operations described above. The computer-readable data storage medium may form part of a computer program product, which may include packaging materials.

The computer-readable medium may include memory or data storage media, such as random access memory (RAM) such as synchronous dynamic random access memory (SDRAM), read-only memory (ROM), non-volatile random access memory (NVRAM), electrically erasable programmable read-only memory (EEPROM), FLASH memory, magnetic or optical data storage media, and the like. The techniques additionally, or alternatively, may be realized at least in part by a computer-readable communication medium that carries or communicates program code in the form of instructions or data structures and that can be accessed, read, and/or executed by a computer, such as propagated signals or waves.

Other embodiments of the disclosure may be practiced in network computing environments with many types of computer system configurations, including personal computers, hand-held devices, multi-processor systems, microprocessor-based or programmable consumer electronics, network PCs, minicomputers, mainframe computers, and the like. Embodiments may also be practiced in distributed computing environments where tasks are performed by local and remote processing devices that are linked (either by hardwired links, wireless links, or by a combination thereof) through a communications network. In a distributed computing environment, program modules may be located in both local and remote memory storage devices.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures and components have not been described in detail so as not to obscure the related relevant feature being described. Also, the description is not to be considered as limiting the scope of the embodiments described herein. The drawings are not necessarily to scale and the proportions of certain parts have been exaggerated to better illustrate details and features of the present disclosure.

In the above description, terms such as "upper," "upward," "lower," "downward," "above," "below," "downhole," "uphole," "longitudinal," "lateral," and the like, as used herein, shall mean in relation to the bottom or furthest extent of the surrounding wellbore even though the wellbore or portions of it may be deviated or horizontal. Correspondingly, the transverse, axial, lateral, longitudinal, radial, etc., orientations shall mean orientations relative to the orientation of the wellbore or tool. Additionally, the illustrate embodiments are illustrated such that the orientation is such that the right-hand side is downhole compared to the left-hand side.

The term "coupled" is defined as connected, whether directly or indirectly through intervening components, and is not necessarily limited to physical connections. The connection can be such that the objects are permanently connected or releasably connected. The term "outside" refers to a region that is beyond the outermost confines of a physical object. The term "inside" indicate that at least a portion of a region is partially contained within a boundary formed by the object. The term "substantially" is defined to be essentially conforming to the particular dimension, shape or other word that substantially modifies, such that the component need not be exact. For example, substantially cylindrical means that the object resembles a cylinder, but can have one or more deviations from a true cylinder.

The term "radially" means substantially in a direction along a radius of the object, or having a directional component in a direction along a radius of the object, even if the object is not exactly circular or cylindrical. The term "axially" means substantially along a direction of the axis of the object. If not specified, the term axially is such that it refers to the longer axis of the object.

Although a variety of information was used to explain aspects within the scope of the appended claims, no limitation of the claims should be implied based on particular features or arrangements, as one of ordinary skill would be able to derive a wide variety of implementations. Further and although some subject matter may have been described in language specific to structural features and/or method steps, it is to be understood that the subject matter defined in the appended claims is not necessarily limited to these described features or acts. Such functionality can be distributed differently or performed in components other than those identified herein. The described features and steps are disclosed as possible components of systems and methods within the scope of the appended claims.

Moreover, claim language reciting "at least one of" a set indicates that one member of the set or multiple members of the set satisfy the claim. For example, claim language reciting "at least one of A and B" means A, B, or A and B.

Statements of the disclosure include:

Statement 1: A method comprising obtaining data defining a configuration of a wellbore having a complex well trajectory, one or more operations to be performed at the wellbore, one or more loads associated with the wellbore, the complex well trajectory comprising one or more undulating sections; calculating, via one or more processors, environmental conditions associated with a set of wellbore components along the complex well trajectory based on the data defining the configuration of the wellbore, the one or more operations, and the one or more loads; calculating, via the one or more processors, stress conditions associated with the set of wellbore components based on the environmental conditions and the data defining the configuration of the wellbore, the one or more operations, and the one or more loads; and presenting the environmental conditions and the stress conditions via a graphical user interface.

Statement 2: A method according to Statement 1, wherein the data comprises at least one of a first indication of a respective type of load associated with the one or more loads, a second indication of a respective type of operation associated with the one or more operations, one or more parameters of a multi-string system associated with the wellbore, a load sequence associated with the one or more operations, a load history associated with the multi-string system, an initial load condition, and a final load condition resulting from the one or more operations, wherein the set of wellbore components comprises the multi-string system.

Statement 3: A method according to any of Statements 1 and 2, wherein the environmental conditions are calculated to account for an effect of the complex well trajectory on the environmental conditions, and wherein the stress conditions are calculated to account for an effect of the complex well trajectory on the stress conditions, the environmental conditions comprising temperature and pressure conditions.

Statement 4: A method according to any of Statements 1 through 3, wherein calculating the stress conditions further comprises calculating, based on the environmental conditions and the complex well trajectory, at least one of a trapped annular pressure buildup associated with at least one of the wellbore and a multi-string system associated with the set of wellbore components, a trapped annular fluid expansion associated with at least one of the wellbore and the multi-string system, one or more design limits associated with the wellbore, one or more safety factors, a wellhead movement, and a displacement associated with one or more of the set of wellbore components.

Statement 5: A method according to any of Statements 1 through 4, wherein the one or more safety factors comprise at least one of a burst safety factor, a triaxial safety factor, a tension safety factor, a collapse safety factor, a length change associated with one or more wellbore components, a casing wear allowance, and a compression safety factor, and wherein the one or more design limits are based on at least one of a load, a pressure, and at least one of the one or more safety factors.

Statement 6: A method according to any of Statements 1 through 5, wherein the one or more operations comprise at least one of a fracturing operation, an injection operation, a production operation, a circulation operation, a drilling operation, a cementing operation, a logging operation, a workover operation, and a casing operation, and wherein the environmental conditions comprise temperature and pressure conditions.

Statement 7: A method according to any of Statements 1 through 6, wherein calculating environmental conditions further comprises calculating at least one of a fluid flow and heat transfer associated with the one or more operations and one or more types of fluid used during a life cycle of the wellbore, a respective temperature profile for one or more of the set of well components, a respective pressure profile for one or more of the set of well components, a flowstream temperature profile, and a flowstream pressure profile.

Statement 8: A method according to any of Statements 1 through 7, wherein the set of wellbore components comprises at least one of a casing, a liner, an operating string, a multi-string system, an annulus, and tubing, a tieback, and wherein data and the configuration of the wellbore comprise at least one of a well path configuration representing the complex well trajectory, a casing configuration, a tubing configuration, a formation and properties around the wellbore, fluid properties, geothermal properties associated with the wellbore, flowrate properties, an inlet temperature, flow direction, a depth associated with at least one of the wellbore and the one or more operations, a reference pressure and location, and mechanical properties associated with the wellbore.

Statement 9: A method according to any of Statements 1 through 8, further comprising generating a simulation of the environmental conditions and the stress conditions and using the simulation of the environmental conditions and the stress conditions for at least one of designing one or more of the set of wellbore components, calculating the environmental conditions, and calculating the stress conditions.

Statement 10: A system comprising: one or more processors; and at least one computer-readable storage medium having stored therein instructions which, when executed by the one or more processors, cause the system to: obtain data defining a configuration of a wellbore having a complex well trajectory, one or more operations to be performed at the wellbore, one or more loads associated with the wellbore, the complex well trajectory comprising one or more undulating sections; calculate environmental conditions associated with a set of wellbore components along the complex well trajectory based on the data defining the configuration of the wellbore, the one or more operations, and the one or more loads; calculate stress conditions associated with the set of wellbore components based on the environmental conditions and the data defining the configuration of the wellbore, the one or more operations, and the one or more loads; and present the environmental conditions and the stress conditions via a graphical user interface.

Statement 11: A system according to Statement 10, wherein the data comprises at least one of a first indication of a respective type of load associated with the one or more loads, a second indication of a respective type of operation associated with the one or more operations, one or more parameters of a multi-string system associated with the wellbore, a load sequence associated with the one or more operations, a load history associated with the multi-string system, an initial load condition, and a final load condition resulting from the one or more operations, wherein the set of wellbore components comprises the multi-string system.

Statement 12: A system according to any of Statements 10 and 11, wherein the environmental conditions are calculated to account for an effect of the complex well trajectory on the environmental conditions, and wherein the stress conditions are calculated to account for an effect of the complex well trajectory on the stress conditions, the environmental conditions comprising temperature and pressure conditions.

Statement 13: A system according to any of Statements 10 through 12, wherein calculating the stress conditions further comprises calculating, based on the environmental conditions and the complex well trajectory, at least one of a trapped annular pressure buildup associated with at least one of the wellbore and a multi-string system associated with the set of wellbore components, a trapped annular fluid expansion associated with at least one of the wellbore and the multi-string system, one or more design limits associated with the wellbore, one or more safety factors, a wellhead movement, and a displacement associated with one or more of the set of wellbore components.

Statement 14: A system according to any of Statements 10 through 13, wherein the one or more safety factors comprise at least one of a burst safety factor, a triaxial safety factor, a tension safety factor, a collapse safety factor, a length change associated with one or more wellbore components, a casing wear allowance, and a compression safety factor, and wherein the one or more design limits are based on at least one of a load, a pressure, and at least one of the one or more safety factors.

Statement 15: A system according to any of Statements 10 through 14, wherein calculating environmental conditions further comprises calculating at least one of a fluid flow and heat transfer associated with the one or more operations and one or more types of fluid used during a life cycle of the wellbore, a respective temperature profile for one or more of the set of well components, a respective pressure profile for one or more of the set of well components, a flowstream temperature profile, and a flowstream pressure profile.

Statement 16: A system according to any of Statements 10 through 15, wherein the set of wellbore components comprises at least one of a casing, a liner, an operating string, a multi-string system, an annulus, a tieback, and tubing, and wherein data and the configuration of the wellbore comprise at least one of a well path configuration representing the complex well trajectory, a casing configuration, a tubing configuration, a formation and properties around the wellbore, fluid properties, geothermal properties associated with the wellbore, flowrate properties, an inlet temperature, flow direction, a depth associated with at least one of the wellbore and the one or more operations, a reference pressure and location, and mechanical properties associated with the wellbore.

Statement 17: A system according to any of Statements 10 through 16, the at least one computer-readable storage medium storing additional instructions which, when executed by the one or more processors, cause the one or more processors to generate a simulation of the environmental conditions and the stress conditions, and use the simulation of the environmental conditions and the stress conditions for at least one of designing one or more of the set of wellbore components, calculating the environmental conditions, and calculating the stress conditions.

Statement 18: A system according to any of Statements 10 through 17, wherein the one or more operations comprise at least one of a fracturing operation, an injection operation, a production operation, a circulation operation, a drilling operation, a cementing operation, a logging operation, a workover operation, and a casing operation, and wherein the environmental conditions comprise temperature and pressure conditions.

Statement 19: A non-transitory computer-readable storage medium comprising instructions stored on the non-transitory computer-readable storage medium, the instructions, when executed by one more processors, cause the one or more processors to obtain data defining a configuration of a wellbore having a complex well trajectory, one or more operations to be performed at the wellbore, one or more loads associated with the wellbore, the complex well trajectory comprising one or more undulating sections; calculate environmental conditions associated with a set of wellbore components along the complex well trajectory based on the data defining the configuration of the wellbore, the one or more operations, and the one or more loads; calculate stress conditions associated with the set of wellbore components based on the environmental conditions and the data defining the configuration of the wellbore, the one or more operations, and the one or more loads; and present the environmental conditions and the stress conditions via a graphical user interface.

Statement 20: A non-transitory computer-readable storage medium according to Statement 19, wherein the data comprises at least one of a first indication of a respective type of load associated with the one or more loads, a second indication of a respective type of operation associated with the one or more operations, one or more parameters of a multi-string system associated with the wellbore, a load sequence associated with the one or more operations, a load history associated with the multi-string system, an initial load condition, and a final load condition resulting from the one or more operations, wherein the set of wellbore components comprises the multi-string system.

Statement 21: A non-transitory computer-readable storage medium according to any of Statements 19 and 20, wherein the environmental conditions are calculated to account for an effect of the complex well trajectory on the environmental conditions, and wherein the stress conditions are calculated to account for an effect of the complex well trajectory on the stress conditions, the environmental conditions comprising temperature and pressure conditions.

Statement 22: A non-transitory computer-readable storage medium according to any of Statements 19 through 21, wherein calculating the stress conditions further comprises calculating, based on the environmental conditions and the complex well trajectory, at least one of a trapped annular pressure buildup associated with at least one of the wellbore and a multi-string system associated with the set of wellbore components, a trapped annular fluid expansion associated with at least one of the wellbore and the multi-string system, one or more design limits associated with the wellbore, one or more safety factors, a wellhead movement, and a displacement associated with one or more of the set of wellbore components.

Statement 23: A non-transitory computer-readable storage medium according to any of Statements 19 through 22, wherein the one or more safety factors comprise at least one of a burst safety factor, a triaxial safety factor, a tension safety factor, a collapse safety factor, a length change associated with one or more wellbore components, a casing wear allowance, and a compression safety factor, and wherein the one or more design limits are based on at least one of a load, a pressure, and at least one of the one or more safety factors.

Statement 24: A non-transitory computer-readable storage medium according to any of Statements 19 through 23, wherein calculating environmental conditions further comprises calculating at least one of a fluid flow and heat transfer associated with the one or more operations and one or more types of fluid used during a life cycle of the wellbore, a respective temperature profile for one or more of the set of well components, a respective pressure profile for one or more of the set of well components, a flowstream temperature profile, and a flowstream pressure profile.

Statement 25: A non-transitory computer-readable storage medium according to any of Statements 19 through 24, wherein the set of wellbore components comprises at least one of a casing, a liner, an operating string, a multi-string system, an annulus, a tieback, and tubing, and wherein data and the configuration of the wellbore comprise at least one of a well path configuration representing the complex well trajectory, a casing configuration, a tubing configuration, a formation and properties around the wellbore, fluid properties, geothermal properties associated with the wellbore, flowrate properties, an inlet temperature, flow direction, a depth associated with at least one of the wellbore and the one or more operations, a reference pressure and location, and mechanical properties associated with the wellbore.

Statement 26: A non-transitory computer-readable storage medium according to any of Statements 19 through 25, storing additional instructions which, when executed by the one or more processors, cause the one or more processors to generate a simulation of the environmental conditions and the stress conditions, and use the simulation of the environmental conditions and the stress conditions for at least one of designing one or more of the set of wellbore components, calculating the environmental conditions, and calculating the stress conditions.

Statement 27: A non-transitory computer-readable storage medium according to any of Statements 19 through 26, wherein the one or more operations comprise at least one of a fracturing operation, an injection operation, a production operation, a circulation operation, a drilling operation, a cementing operation, a logging operation, a workover operation, and a casing operation, and wherein the environmental conditions comprise temperature and pressure conditions.

Statement 28: A system comprising means for performing a method according to any of Statements 1 through 9.

What is claimed is:

1. A method comprising:

obtaining data defining a configuration of a wellbore having a complex well trajectory, one or more operations to be performed at the wellbore, one or more loads associated with the wellbore, the complex well trajectory comprising one or more undulating sections;

calculating, via one or more processors, environmental conditions including a temperature profile and a pressure profile associated with a set of wellbore components along the one or more undulating sections of the complex well trajectory based on the data defining the configuration of the wellbore, the one or more operations, and the one or more loads;

calculating, via the one or more processors, stress conditions associated with the set of wellbore components based on the environmental conditions including the temperature profile and the pressure profile along the one or more undulating sections of the complex well trajectory and the data defining the configuration of the wellbore, the one or more operations, and the one or more loads; and performing an operation during a well drilling, a well completion, or a production lifecycle based on the environmental conditions, the temperature profile, the pressure profile, and the stress conditions.

2. The method of claim 1, wherein the data comprises at least one of a first indication of a respective type of load associated with the one or more loads, a second indication of a respective type of operation associated with the one or more operations, one or more parameters of a multi-string system associated with the wellbore, a load sequence associated with the one or more operations, a load history associated with the multi-string system, an initial load condition, and a final load condition resulting from the one or more operations, wherein the set of wellbore components comprises the multi-string system.

3. The method of claim 1, wherein calculating the stress conditions further comprises calculating, based on the environmental conditions and the complex well trajectory, at least one of a trapped annular pressure buildup associated with at least one of the wellbore and a multi-string system associated with the set of wellbore components, a trapped annular fluid expansion associated with at least one of the wellbore and the multi-string system, one or more design limits associated with the wellbore, one or more safety factors, a wellhead movement, and a displacement associated with one or more of the set of wellbore components.

4. The method of claim 3, wherein the one or more safety factors comprise at least one of a burst safety factor, a triaxial safety factor, a tension safety factor, a collapse safety factor, a length change associated with one or more wellbore components, a casing wear allowance, and a compression safety factor, and wherein the one or more design limits are based on at least one of a load, a pressure, and at least one of the one or more safety factors.

5. The method of claim 1, wherein the one or more operations comprise at least one of a fracturing operation, an injection operation, a production operation, a circulation operation, a drilling operation, a cementing operation, a logging operation, a workover operation, and a casing operation, and wherein the environmental conditions comprise temperature and pressure conditions.

6. The method of claim 1, wherein calculating environmental conditions further comprises calculating at least one of a fluid flow and heat transfer associated with the one or more operations and one or more types of fluid used during a life cycle of the wellbore, a respective temperature profile for one or more of the set of well components, a respective pressure profile for one or more of the set of well components, a flowstream temperature profile, and a flowstream pressure profile.

7. The method of claim 1, wherein the set of wellbore components comprises at least one of a casing, a liner, an operating string, a multi-string system, an annulus, a tieback, and tubing, and wherein data and the configuration of the wellbore comprise at least one of a well path configuration representing the complex well trajectory, a casing configuration, a tubing configuration, a formation and properties around the wellbore, fluid properties, geothermal properties associated with the wellbore, flowrate properties, an inlet temperature, flow direction, a depth associated with at least one of the wellbore and the one or more operations, a reference pressure and location, and mechanical properties associated with the wellbore.

8. The method of claim 1, further comprising generating a simulation of the environmental conditions and the stress conditions and using the simulation of the environmental conditions and the stress conditions for at least one of designing one or more of the set of wellbore components, calculating the environmental conditions, and calculating the stress conditions.

9. A system comprising:

one or more processors; and at least one computer-readable storage medium having stored therein instructions which, when executed by the one or more processors, cause the system to:

obtain data defining a configuration of a wellbore having a complex well trajectory, one or more operations to be performed at the wellbore, one or more loads associated with the wellbore, the complex well trajectory comprising one or more undulating sections;

calculate environmental conditions including a temperature profile and a pressure profile associated with a set of wellbore components along the one or more undulating sections of the complex well trajectory based on the data defining the configuration of the wellbore, the one or more operations, and the one or more loads;

calculate stress conditions associated with the set of wellbore components based on the environmental conditions including the temperature profile and the pressure profile along the one or more undulating sections of the complex well trajectory and the data defining the configuration of the wellbore, the one or more operations, and the one or more loads; and perform an operation during a well drilling, a well completion, or a production lifecycle based on the environmental conditions, the temperature profile, the pressure profile, and the stress conditions.

10. The system of claim 9, wherein the data comprises at least one of a first indication of a respective type of load associated with the one or more loads, a second indication of a respective type of operation associated with the one or more operations, one or more parameters of a multi-string system associated with the wellbore, a load sequence associated with the one or more operations, a load history associated with the multi-string system, an initial load condition, and a final load condition resulting from the one or more operations, wherein the set of wellbore components comprises the multi-string system.

11. The system of claim 9 wherein calculating the stress conditions further comprises calculating, based on the environmental conditions and the complex well trajectory, at least one of a trapped annular pressure buildup associated with at least one of the wellbore and a multi-string system associated with the set of wellbore components, a trapped annular fluid expansion associated with at least one of the wellbore and the multi-string system, one or more design limits associated with the wellbore, one or more safety factors, a wellhead movement, and a displacement associated with one or more of the set of wellbore components.

12. The system of claim 11, wherein the one or more safety factors comprise at least one of a burst safety factor, a triaxial safety factor, a tension safety factor, a collapse safety factor, a length change associated with one or more wellbore components, a casing wear allowance, and a compression safety factor, and wherein the one or more design limits are based on at least one of a load, a pressure, and at least one of the one or more safety factors.

13. The system of claim 9, wherein calculating environmental conditions further comprises calculating at least one of a fluid flow and heat transfer associated with the one or more operations and one or more types of fluid used during a life cycle of the wellbore, a respective temperature profile for one or more of the set of well components, a respective pressure profile for one or more of the set of well components, a flowstream temperature profile, and a flowstream pressure profile.

14. The system of claim 9, wherein the set of wellbore components comprises at least one of a casing, a liner, an operating string, a multi-string system, an annulus, a tieback, and tubing, and wherein data and the configuration of the wellbore comprise at least one of a well path configuration representing the complex well trajectory, a casing configuration, a tubing configuration, a formation and properties around the wellbore, fluid properties, geothermal properties associated with the wellbore, flowrate properties, an inlet temperature, flow direction, a depth associated with at least one of the wellbore and the one or more operations, a reference pressure and location, and mechanical properties associated with the wellbore.

15. The system of claim 9, the at least one computer-readable storage medium storing additional instructions which, when executed by the one or more processors, cause the one or more processors to:

generate a simulation of the environmental conditions and the stress conditions; and use the simulation of the environmental conditions and the stress conditions for at least one of designing one or more of the set of wellbore components, calculating the environmental conditions, and calculating the stress conditions.

16. A non-transitory computer-readable storage medium comprising:

instructions stored on the non-transitory computer-readable storage medium, the instructions, when executed by one more processors, cause the one or more processors to:

obtain data defining a configuration of a wellbore having a complex well trajectory, one or more operations to be performed at the wellbore, one or more loads associated with the wellbore, the complex well trajectory comprising one or more undulating sections;

calculate environmental conditions including a temperature profile and a pressure profile associated with a set of wellbore components along the one or more undulating sections of the complex well trajectory based on the data defining the configuration of the wellbore, the one or more operations, and the one or more loads;

calculate stress conditions associated with the set of wellbore components based on the environmental conditions including the temperature profile and the pressure profile along the one or more undulating sections of the complex well trajectory and the data defining the configuration of the wellbore, the one or more operations, and the one or more loads; and perform an operation during a well drilling, a well completion, or a production lifecycle based on the environmental conditions, the temperature profile, the pressure profile, and the stress conditions.

17. The non-transitory computer-readable storage medium of claim 16, wherein the data comprises at least one of a first indication of a respective type of load associated with the one or more loads, a second indication of a respective type of operation associated with the one or more operations, one or more parameters of a multi-string system associated with the wellbore, a load sequence associated with the one or more operations, a load history associated with the multi-string system, an initial load condition, and a final load condition resulting from the one or more operations, wherein the set of wellbore components comprises the multi-string system, and wherein the environmental conditions comprise temperature and pressure conditions.

18. The non-transitory computer-readable storage medium of claim 16, wherein calculating the stress conditions further comprises calculating, based on the environmental conditions and the complex well trajectory, at least one of a trapped annular pressure buildup associated with at least one of the wellbore and a multi-string system associated with the set of wellbore components, a trapped annular fluid expansion associated with at least one of the wellbore and the multi-string system, one or more design limits associated with the wellbore, one or more safety factors, a wellhead movement, and a displacement associated with one or more of the set of wellbore components, and wherein the one or more safety factors comprise at least one of a burst safety factor, a triaxial safety factor, a tension safety factor, a collapse safety factor, a length change associated with one or more wellbore components, a casing wear allowance, and a compression safety factor, and wherein the one or more design limits are based on at least one of a load, a pressure, and at least one of the one or more safety factors.

* * * * *